US012796784B2

(12) United States Patent
Sagara et al.

(10) Patent No.: US 12,796,784 B2
(45) Date of Patent: Nov. 17, 2026

(54) FLAME-RETARDANT HOOK-AND-LOOP FASTENER

(71) Applicant: KURARAY FASTENING CO., LTD., Osaka (JP)

(72) Inventors: Makoto Sagara, Sakai (JP); Yoshikatsu Fujisawa, Sakai (JP)

(73) Assignee: Kuraray Fastening Co., Ltd., Osaka (JP)

( * ) Notice: Subject to any disclaimer, the term of this patent is extended or adjusted under 35 U.S.C. 154(b) by 195 days.

(21) Appl. No.: 18/843,769

(22) PCT Filed: Mar. 6, 2023

(86) PCT No.: PCT/JP2023/008256
§ 371 (c)(1),
(2) Date: Sep. 4, 2024

(87) PCT Pub. No.: WO2023/171602
PCT Pub. Date: Sep. 14, 2023

(65) Prior Publication Data

US 2025/0169578 A1 May 29, 2025

(30) Foreign Application Priority Data

Mar. 7, 2022 (JP) ..... 2022-034177

(51) Int. Cl.
*A44B 18/00* (2006.01)
*D02G 3/36* (2006.01)
(Continued)

(52) U.S. Cl.
CPC ..... *A44B 18/0092* (2013.01); *A44B 18/0023* (2013.01); *D02G 3/36* (2013.01);
(Continued)

(58) Field of Classification Search
CPC .. A44B 18/0023; A44B 18/0092; D02G 3/36; D03D 15/283; D03D 15/37; D03D 15/47;
(Continued)

(56) References Cited

U.S. PATENT DOCUMENTS

| | | | |
|---|---|---|---|
| 2010/0043183 | A1 | 2/2010 | Higashinaka et al. |
| 2024/0000198 | A1 | 1/2024 | Sagara et al. |
| 2024/0279850 | A1 | 8/2024 | Sagara |

FOREIGN PATENT DOCUMENTS

| | | |
|---|---|---|
| JP | 2015-62599 | 4/2015 |
| JP | 2019-154880 | 9/2019 |

(Continued)

OTHER PUBLICATIONS

International Search Report received for PCT Application No. PCT/JP2023/008256, mailed on May 16, 2023, 5 pages with English translation.

(Continued)

*Primary Examiner* — Lawrence D Ferguson
(74) *Attorney, Agent, or Firm* — Grüneberg Global IP, PLLC

(57) ABSTRACT

A flame-retardant hook-and-loop fastener including: a base fabric woven from a warp yarn formed of a polyphenylene sulfide-based multifilament yarn, a weft yarn formed of a polyphenylene sulfide-based multifilament yarn and a multifilament yarn formed of a heat-fusible filament, and a yarn for an engaging element formed of at least one selected from the group consisting of a polyphenylene sulfide-based multifilament yarn and monofilament yarn; and the engaging element formed of the yarn for the engaging element and being present in a front face of the base fabric, in which a thickness of the warp yarn in a base fabric thickness direction at a position at which the warp yarn, which alternately runs over and under the weft yarn with the weft yarn interposed therebetween, subducts most toward a rear face
(Continued)

side is 0.94 times or less of a thickness of the warp yarn in the base fabric thickness direction at a position at which the warp yarn floats most toward a front face side.

14 Claims, 2 Drawing Sheets

(51) Int. Cl.

| | |
|---|---|
| ***D03D 15/283*** | (2021.01) |
| ***D03D 15/47*** | (2021.01) |
| ***D03D 15/567*** | (2021.01) |
| ***D03D 15/587*** | (2021.01) |
| ***D03D 27/04*** | (2006.01) |
| ***D06C 7/00*** | (2006.01) |

(52) U.S. Cl.
CPC ..... *D03D 15/283* (2021.01); *D03D 15/47* (2021.01); *D03D 15/567* (2021.01); *D03D 15/587* (2021.01); *D03D 27/04* (2013.01); *D06C 7/00* (2013.01); *D10B 2331/04* (2013.01); *D10B 2331/301* (2013.01); *D10B 2401/04* (2013.01); *D10B 2505/00* (2013.01)

(58) Field of Classification Search
CPC .... D03D 15/513; D03D 15/54; D03D 15/567; D03D 15/587; D03D 27/02; D03D 27/04; D06C 7/00; D10B 2331/04; D10B 2331/301; D10B 2401/04; D10B 2401/041; D10B 2401/14; D10B 2501/0632; D10B 2505/00
See application file for complete search history.

(56) References Cited

FOREIGN PATENT DOCUMENTS

| | | |
|---|---|---|
| WO | 2008/059958 | 5/2008 |
| WO | 2021/054389 | 3/2021 |
| WO | 2022/097593 | 5/2022 |
| WO | 2022/270159 | 12/2022 |

OTHER PUBLICATIONS

Written Opinion received for PCT Application No. PCT/JP2023/008256, mailed on May 16, 2023, 8 pages with English translation.
Official communication issued in European Patent Application No. 23766778.7 on Feb. 12, 2026, 7 pages.

[Fig. 1]
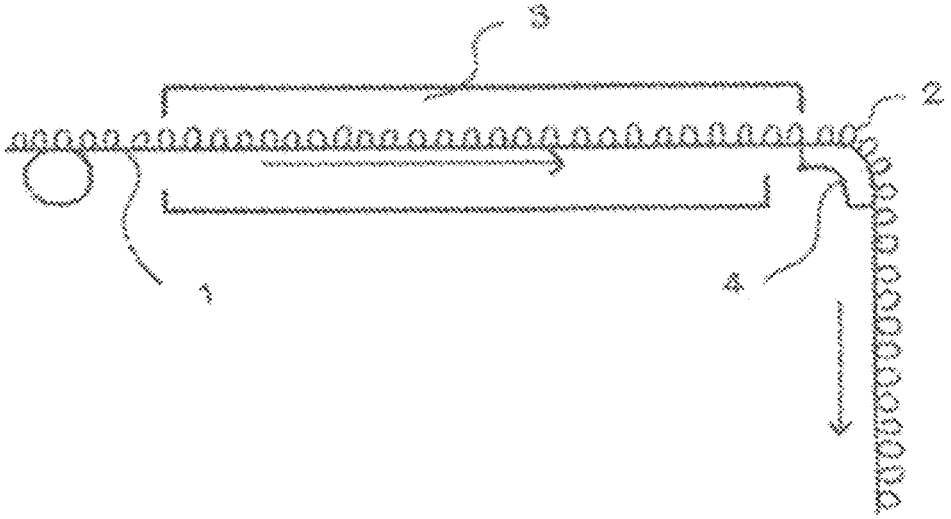
[Fig. 2]
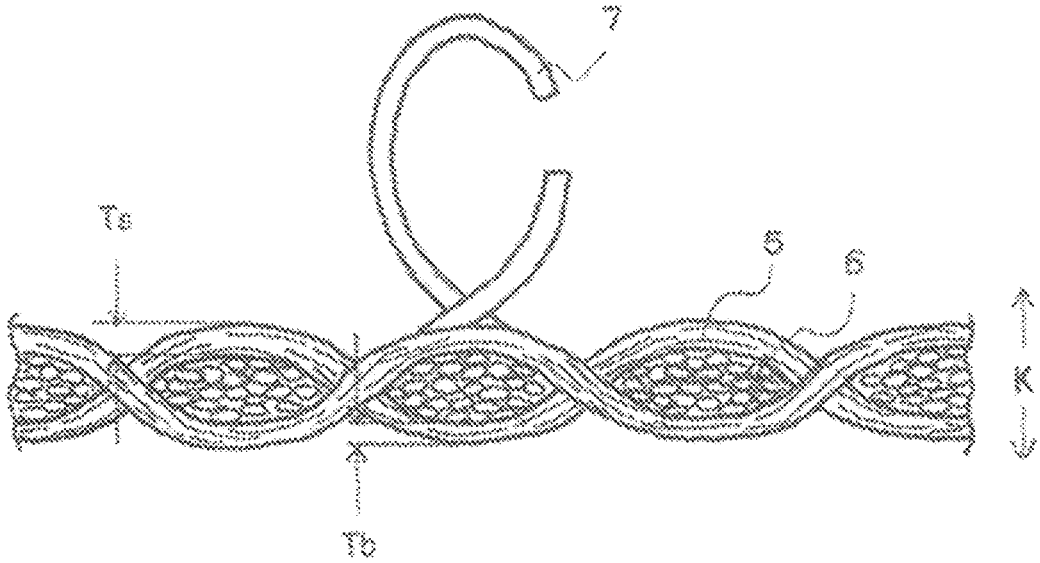

[Fig. 3]
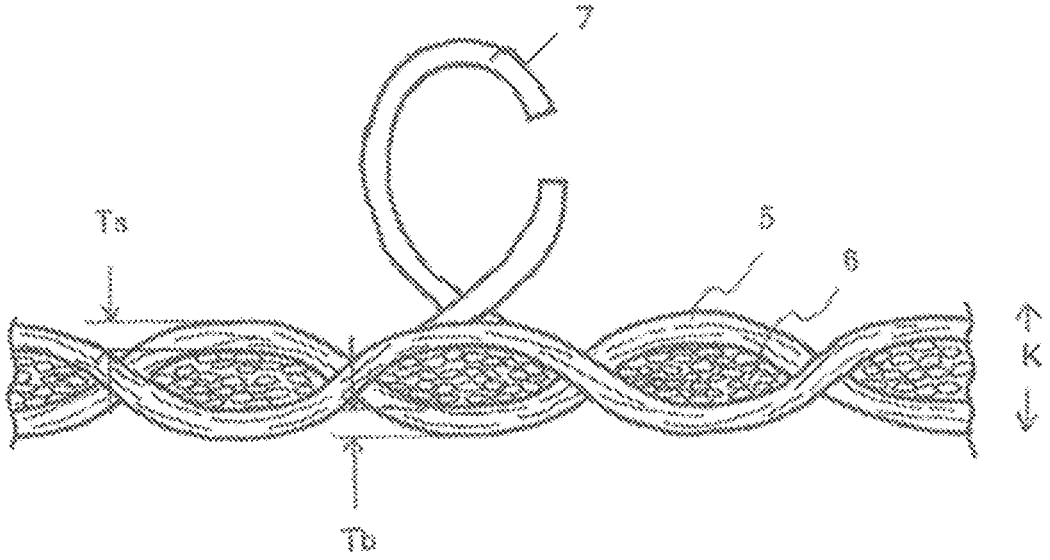

FLAME-RETARDANT HOOK-AND-LOOP FASTENER

CROSS-REFERENCE TO RELATED APPLICATIONS

This application is the National Stage entry under § 371 of International Application No. PCT/JP2023/008256, filed on Mar. 6, 2023, and which claims the benefit of priority to Japanese Patent Application No. 2022-034177, filed on Mar. 7, 2022. The content of each of these applications is hereby incorporated by reference in its entirety.

TECHNICAL FIELD

The present invention relates to a woven-fabric-based flame-retardant hook-and-loop fastener which is excellent in flame retardancy, in which engaging elements are less likely to be pulled out from a woven base fabric even when engagement and peeling are repeated, further, in which a waving in an up-and-down direction hardly occurs in the hook-and-loop fastener, which is also excellent in engaging force, and which can be widened, and a method for producing the same.

BACKGROUND ART

Conventionally, as a hook-and-loop fastener having a woven base fabric, a combination of a so-called woven-fabric based hook hook-and-loop fastener including a large number of hook-shaped engaging elements made of a monofilament yarn on the front face of the woven base fabric and a so-called woven-fabric based loop hook-and-loop fastener including a large number of loop-shaped engaging elements made of a multifilament yarn capable of engaging with the hook-shaped engaging elements on the front face of the woven base fabric has been widely used in application fields such as clothes, daily sundries, industrial materials, and the like because the engaging elements are not damaged and the engaging force is less reduced even when engagement and peeling are repeated.

In addition, a so-called hook-and-loop coexisting woven-fabric based hook-and-loop fastener including both of a large number of the hook-shaped engaging elements and a large number of the loop-shaped engaging elements on the same front face of the woven base fabric is also widely used because one kind of hook-and-loop fastener has both the functions of a hook hook-and-loop fastener and a loop hook-and-loop fastener, so that it is not necessary to use both of the hook hook-and-loop fastener and the loop hook-and-loop fastener in combination, unlike a conventional hook-and-loop fastener.

In recent years, a hook-and-loop fastener has been widely used as a means for fixing parts, such as wall surfaces, ceilings, and floor materials in vehicles such as automobiles, trains, ships, and aircrafts; structural materials; and heat insulating materials. In these application fields, a high degree of flame retardancy is required, and a high degree of flame retardancy is also required for a hook-and-loop fastener to be used. Furthermore, a hook-and-loop fastener having a high degree of flame retardancy is also required in the field of special clothes such as working clothes at high-temperature sites such as blast furnaces and foundries; and firefighting clothes and in the field requiring flame retardancy and heat resistance such as filter fixing materials for high-temperature gas.

Various kinds, as a flame-retardant hook-and-loop fastener, have been proposed to meet such requirements. For example, a hook-and-loop fastener obtained by impregnating or coating, with a resin including a flame-retardant, a front face of an ordinary woven-fabric-based hook-and-loop fastener to impart flame retardancy, is general. However, such a hook-and-loop fastener has a problem that the flame-retardant applied to the front face is peeled off as the engagement and peeling are repeated, or the flame-retardant disappears due to washing or the like, so that the flame-retardant effect cannot be maintained.

Further, in the case of an ordinary woven-fabric-based hook-and-loop fastener, in order to prevent the engaging elements from being pulled out from the base fabric front face due to the repetition of engagement and peeling, a polyurethane-based or polyacrylic adhesive liquid so-called a back coating resin is applied to the rear face of the hook-and-loop fastener. However, when the adhesive is applied to the rear face, the hook-and-loop fastener loses flexibility and becomes rigid, and the texture of a woven-fabric or the like to which the hook-and-loop fastener is attached is largely deteriorated, and further, since it becomes further rigid, it is difficult to engage, and the engagement performance is also deteriorated.

Further, since the process of weaving the hook-and-loop fastener and the process of coating the rear face with the back coating resin liquid and drying the hook-and-loop fastener are greatly different from each other in the process passing speed, it is necessary to wind the hook-and-loop fastener once in the middle, which requires labor and time for the production of the hook-and-loop fastener. Further, in order to make the hook-and-loop fastener flame-retardant, it is necessary to add a flame-retardant to the adhesive for the back coating, but when such a back coating adhesive containing a flame-retardant is used, there arise problems of stabilization of the adhesive liquid and bleed-out of the flame-retardant, and there also arise a problem that the back coating effect is lowered.

As a technique for solving the problems of the technique to make the hook-and-loop fastener flame-retardant by impregnating and coating with such a flame-retardant or coating with a flame-retardant-added back coating resin liquid, there has been proposed a woven-fabric-based flame-retardant hook-and-loop fastener in which a yarn made of a flame-retardant fiber represented by a polyphenylene sulfide (hereinafter abbreviated as PPS) fiber is used as a yarn constituting a hook-and-loop fastener is used, and a heat-fusible yarn is used in a part of the welt yarn. For example, PTL1 describes that a PPS-based multifilament yarn is used as a warp yarn, a paralleled yarn of a multifilament yarn made of a PPS-based multifilament yarn and a heat-fusible core-sheath type filament is used as a weft yarn, and further, a PPS-based multifilament yarn or monofilament yarn is used as a yarn for the engagement element, a flame-retardant foot-and-loop fastener is obtained by weaving a woven-fabric for a hoot-and-loop fastener which is made of the warp yarn, the weft yarn and the yarn for the engaging element and on which the yarn for the engaging element protrudes in a loop shape on the surface, and thereby heat-melting a heat-fusible component of the multifilament yarn made of the heat-fusible core-sheath type filament to fuse and fix the yarn constituting the woven base fabric, and by cutting one leg of the loop to form a hook-shaped engaging element when the loop for the engaging element is made of a monofilament yarn.

In the case of the flame-retardant hook-and-loop fastener obtained based on the technique described in PTL 1, it is effective to increase the proportion of the PPS yarn constituting the hook-and-loop fastener and to decrease the proportion of the multifilament yarn made of the heat-fusible core-sheath type filament, in order to achieve a high level of flame retardancy which can be used in fields such as an automobile and an aircraft where an extremely high level of flame retardancy is required. However, when the proportion of the PPS yarn is simply increased and the proportion of the multifilament yarn made of the heat-fusible core-sheath type filament is decreased, the fixing of the engaging element by the heat-fusible component becomes insufficient. As a result, when the engagement and peeling are repeated, the problems such as the following occur; the fixing of the engaging element by the multifilament yarn made of the heat-fusible core-sheath type filament is gradually released, the engaging element is pulled out from the base fabric, and the engaging force is reduced.

As a technique for improving a flame-retardant hook-and-loop fastener using such a PPS yarn and a multifilament yarn made of a heat-fusible core-sheath type filament, PTL 2 describes a technique in which a multifilament yarn in which a large number of thin PPS filaments are bundled is used as a PPS yarn used as a part of a weft yarn, and a yarn having high heat shrinkability is used as a multifilament yarn made of a heat-fusible core-sheath type filament used in parallel with the PPS yarn.

When this technique is used, the multifilament yarn made of the heat-fusible core-sheath type filament is highly heat-shrunk at the time of heat-melting to tighten the base of the engaging element, and further, a large number of thin PPS filaments can be gathered in the yarn for the engaging element. Thus, the engaging element can be prevented to some extent from being pulled out from the base fabric by repetition of engagement and peeling, but it is not yet arrived at a satisfactory level.

Further, when the technique of PTL 2 is used, large heat shrinkage occurs when the multifilament yarn made of the heat-fusible core-sheath type filament is heat-melted, and thus the hook-and-loop fastener base fabric has a waving in an up-and-down direction (that is, the hook-and-loop fastener floats and subducts in the up-and-down direction in a wakame seaweed manner). The waving is generated in both the length direction (warp yarn direction) and the width direction (weft yarn direction) of the hook-and-loop fastener, but the use of a highly shrinkable yarn for the weft yarn increases the waving particularly in the width direction, and as a result, it becomes a large obstacle for producing a wide hook-and-loop fastener.

In a woven-fabric hook-and-loop fastener, in particular, a method is generally adopted in which a broad hook-and-loop fastener in which an engaging element area having a loop for an engaging element and an area for a selvage part having no loop for an engaging element are each continuously present in the warp yarn direction, and the engaging element area and the area for the selvage part are alternately present in the weft yarn direction and a plurality of the engaging element area is further present, is firstly woven, and finally, a central part of the area for the selvage part is slit in parallel in the warp direction to simultaneously produce a plurality of hook-and-loop fasteners since it is excellent in productivity. Therefore, when the wide hook-and-loop fastener before slitting has a waving in the up-and-down direction, it is difficult to accurately slit the intermediate part of the selvage part, and a width of the selvage part becomes narrow or becomes wide, and further, the warp yarn comes out from the slit end part of the selvage part, and the quality and appearance are deteriorated.

Further, due to the generation of the waving in the up-and-down direction in the hook-and-loop fastener, when one leg of the loop for the hook-shaped engaging element is cut to form the hook-shaped engaging element, the cut height of the loop varies, and as a result, the engaging force varies, or both legs are cut, cutting is performed partway, and a loop shape remains without being cut.

Further, in the case where the hook-and-loop fastener has a selvage part in which the engaging element is not present at both end parts along the side warp yarn direction, when the hook-and-loop fastener has a waving in the up-and-down direction, these selvage parts are also likely to be misaligned in the weft yarn direction. When the hook-and-loop fastener is attached by sewing, the selvage part is sewn with a sewing thread. However, when the selvage part is misaligned in the weft yarn direction, the sewing thread appears to meander, which is a significant problem in terms of appearance.

Further, PTL 3 describes, as a method for coloring the flame-retardant hook-and-loop fastener using PPS yarn described in PTL 1, a method in which after the flame-retardant hook-and-loop fastener using PPS yarn produced in PTL 1 is immersed in a bath containing an aqueous dispersion of pigments dispersed with a polymer type dispersing agent having an ionic group and a crosslinking agent, taken out from the bath, and drying and heat treatment at 160° C. for 10 minutes are repeated twice while winding the fastener around a heating roll to react the ionic group with the crosslinking agent to firmly adhere the pigments to the front face of the hook-and-loop fastener. However, in this method, in order to prevent the engaging element of the hook-and-loop fastener wound around the heating roll from falling down during the heat treatment, and in order to prevent the overlapping engaging-element face and the rear face of the hook-and-loop fastener wound in a roll shape from adhering to each other to cause a crosslinking reaction and firmly adhering to each other, the hook-and-loop fastener must be in a soft wound state, and the problem of the waving of the hook-and-loop fastener is hardly improved even with further winding and heating in this state. As a result, even when the method of this PTL is used, the above-mentioned problem of hook-and-loop fastener is not solved.

CITATION LIST

Patent Literature

PTL 1: WO2008/059958
PTL 2: JP2019-154880A
PTL 3: JP2015-62599A

SUMMARY OF INVENTION

Technical Problem

The present invention is to obtain a hook-and-loop fastener that is made of a flame-retardant PPS-based woven-fabric and that solves the problems as described above, specifically, a woven-fabric-based flame-retardant hook-and-loop fastener which is excellent in flame retardancy, hardly causes the engaging element to be pulled out from the base fabric even when engagement and peeling are repeated, which hardly causes a waving in the up-and-down direction of the hook-and-loop fastener, which can be widened, in which it is possible that a wide hook-and-loop fastener with the engaging element area divided in the weft direction by an area for a selvage part is woven, the area for the selvage part is slit, thereby obtaining a plurality of hook-and-loop fasteners can be obtained simultaneously, and which has no variation in the cut height of one leg of the hook-shaped engaging element. Further, the present invention is to obtain a flame-retardant woven-fabric-based hook-and-loop fastener with a selvage part which is free from misalignment of the selvage part in the weft yarn direction.

Solution to Problem

That is, the present invention is a flame-retardant hook-and-loop fastener including: a base fabric woven from a warp yarn formed of a PPS-based multifilament yarn, a weft yarn made of a paralleled yarn of a PPS-based multifilament yarn, a multifilament yarn formed of a heat-fusible filament, and a yarn for an engaging element formed of at least one selected from the group consisting of a PPS-based multifilament yarn and a monofilament yarn; and the engaging element formed of the yarn for the engaging element and being present on a front face of the base fabric; in which a thickness of the warp yarn in a base fabric thickness direction at a position at which the warp yarn, which alternately runs over and under the weft yarn with the weft yarn interposed therebetween, subducts most toward a rear face side is 0.94 times or less of the thickness of the warp yarn in the base fabric thickness direction at a position at which the warp yarn floats most toward a front face side.

In addition, preferably, the warp yarn, which alternately runs over and under the weft yarn with the weft yarn interposed therebetween, satisfies a range that the thickness of the warp yarn in the base fabric thickness direction at the position at which the warp yarn subducts most toward the rear face side is 0.70 to 0.90 times the thickness of the warp yarn in the base fabric thickness direction at the position at which the warp floats most toward the front face side. More preferably, in the flame-retardant hook-and-loop fastener described above, the weft yarn is a paralleled yarn of a PPS-based multifilament yarn having a total thickness of 120 to 300 decitex in which 5 to 90 filaments having a thickness of 3 to 30 decitex are bundled and a heat-fusible multifilament yarn having a total thickness of 80 to 150 decitex in which 15 to 40 polyester-based core-sheath type filaments having a thickness of 3 to 8 decitex in which a sheath component is a heat-fusible component having a low melting point are bundled.

Further, in the above-described flame-retardant hook-and-loop fastener, preferably, on the front face of the hook-and-loop fastener, each of the engaging element area on which the engaging element is present and the area for the selvage part on which the engaging element is not present is continuous in the warp yarn direction, and the engaging element area and the area for the selvage part are alternately present, and further a plurality of engagement element areas are present, in the weft yarn direction, that is, a wide hook-and-loop fastener, before slitting the the area for the selvage part to form a plurality of thin hook-and-loop fasteners. Further, preferably, the engaging element is a hook-shaped engaging element, and the pull-out force of the hook-shaped engaging element from the base fabric is 5 N or more. Further, it is preferable that the back coating resin layer is not present on the rear face of the base fabric. Further, it is preferably colored with a pigment or a disperse dye.

Further, the present invention is a method for producing a flame-retardant hook-and-loop fastener, the hook-and-loop fastener includes: a base fabric woven from a warp yarn formed of a polyphenylene sulfide-based multifilament yarn, a weft yarn formed of a polyphenylene sulfide-based multifilament yarn and a multifilament yarn formed of a heat-fusible and heat-shrinkable filament, and a yarn for the engaging element formed of at least one selected from the group consisting of a polyphenylene sulfide-based multifilament yarn and a monofilament yarn; and at least one selected from the group consisting of a large number of hook-shaped engaging elements and a large number of loop-shaped engaging elements, formed of the yarn for the engaging element and present on the front face of the base fabric; in which step A, step B, step C, and step D as described below are performed in the order.

[step A] a step of, at the time of weaving the base fabric from the warp yarn and the weft yarn, weaving the yarn for the engaging element into the warp yarn in parallel, and at the same time, allowing the yarn for the engaging element to regularly run over the warp yarn, and raising the yarn for the engaging element in a loop shape from the front face of the base fabric at a running-over position to weave a loop woven-fabric;

[step B] a step of guiding the loop woven-fabric to a heating region, heating at a temperature equal to or higher than a temperature at which the heat-fusible component of the multifilament yarn made of the heat-fusible and heat-shrinkable filament is melted, heat-shrinking the multifilament yarn made of the heat-fusible and heat-shrinkable filament, and fixing the yarn for the engaging element to the base fabric by a melt from the multifilament yarn made of the heat-fusible and heat-shrinkable filament;

[step C] a step of taking out the loop woven-fabric from the heating region of the step B and sliding the rear face of the base fabric on a fixed surface or a roll surface while pressing the rear face against the fixed surface or the roll surface in a state in which the heat-fusible component of the multifilament yarn made of the heat-fusible and heat-shrinkable filament is melted;

[step D] a step of taking out the loop woven-fabric from the step C, cooling the loop woven-fabric, and then cutting one leg of the loop to form the hook-shaped engaging element from the loop when the yarn for the engaging element is a monofilament yarn;

In such a method for producing the flame-retardant hook-and-loop fastener, preferably, in the step C, while the rear face of the loop woven-fabric is pressed against the fixed surface, the loop woven-fabric is allowed to run while sliding on the fixed surface, and a running direction of the loop woven-fabric is changed on the fixed surface. Further preferably, the step C is carried out by utilizing the residual heat of the step B following the step B without once cooling the loop woven-fabric taken out from the step B.

Further, in such a method for producing the flame-retardant hook-and-loop fastener, preferably, the multifilament yarn made of the heat-fusible and heat-shrinkable filament has a dry-heat shrinkage percentage at 200° C. in the range of 10 to 24%. Moreover, preferably, the tensile force applied to the loop woven-fabric in the step C is 50 to 600 g/cm. Further, it is preferable to continuously perform the step A to the end of the step D without winding the woven-fabric in the middle. Also preferably, the method is, in the step A, weaving the loop woven-fabric in which the engaging element area on which the loop for the engaging element is present and the area for the selvage part on which no loop for the engaging element is present are each continuously present in the warp yarn direction, on the front face of the loop woven-fabric, and the engaging element area and the area for the selvage part are alternately present, and further, a plurality of areas for the engaging element is present in the weft yarn direction; and after the step D, slitting the center of the area for the selvage part in the warp yarn direction to simultaneously produce a plurality of hook-and-loop fasteners that is continuous in the warp direction and that has the selvage parts at both end parts.

Advantageous Effects of Invention

In the flame-retardant woven-fabric hook-and-loop fastener of the present invention, a heat-fusible and heat-shrinkable multifilament yarn is used as a part of the weft yarn, and when this yarn is heat-shrunk at the time of heat-fusion, the effect of tightening the base of the engaging element to prevent the engaging element from being pulled out from the woven base fabric is obtained, but a waving in the up-and-down direction, particularly a waving in the up-and-down direction in the width direction, is generated in the hook-and-loop fastener. As a result, it was difficult to obtain a wide hook-and-loop fastener without a waving. The problem is solved in the present invention by carrying out the step C after the step B, that is, by carrying out the operation of sliding the rear face of the base fabric on a fixed surface or a roll surface while pressing the rear face of the base fabric against the fixed surface or the roll surface when the heat-fusible component of the multifilament yarn made of the heat-fusible and heat-shrinkable filaments are in a molten state after performing the fusion treatment.

As a result, a wide flame-retardant woven-fabric hook-and-loop fastener having almost no waving can be obtained. Therefore, when the present invention is applied to a technique for simultaneously producing a plurality of narrow hook-and-loop fasteners by first producing a wide hook-and-loop fastener and finally slitting the hook-and-loop fastener in parallel in the warp yarn direction, the central part of the area for the selvage can be accurately slit because the hook-and-loop fastener does not have a waving.

In particular, the problem of the waving can be solved to a high degree by using, as the step C, a method in which the loop woven-fabric is allowed to slide and run on the fixed surface while being pressed against the fixed surface, and the running direction is changed on the fixed surface.

Moreover, since the weft yarn includes the heat-shrinkable yarn, the base of the engaging element can be fastened by the heat-shrunk yarn, and the yarn for the engaging element is fixed to the base fabric by the fusion of the heat-fusible component, and further, since the yarns (including the heat-fusible component) constituting the base fabric are press-bonded to adhere to each other by the step C, the melt of the heat-fusible component is extruded from the weft yarn by the press-bonding, and so that the melt penetrates more into the yarns adjacent to each other to increase the bonding force between the yarns, and the like, which are combined with one another, whereby the engaging element is firmly fixed on the base fabric, and further, since the surface ratio of the heat-fusible component impairing the flame retardancy can be reduced, even though there is a little heat-fusible component, it hardly causes the engaging element to be pulled out from the base fabric when engagement and peeling are repeated. At the same time, regarding the flame retardancy, because there is a little proportion of component impairing flame retardancy, that is, the heat-fusible yarn, a hook-and-loop fastener excellent in flame retardancy can be obtained. In particular, by using, as the step C, a method in which the loop woven-fabric is allowed to slide and run on the fixed surface while being pressed against the fixed surface, and the running direction is changed on the fixed surface, the effect of preventing the engaging element from being pulled out from the base fabric is further enhanced while the proportion of the heat-fusible yarn is further suppressed to be low.

Further, when the hook-and-loop fastener is a hook hook-and-loop fastener, one leg of the loop for the hook-shaped engaging element can be surely cut at the same height because the waving of the base fabric in the up-and-down direction is solved by the step C. Therefore, it is possible to prevent a case where both legs are not cut, a case where both legs are cut, a case where the base of one leg is cut, and a case where a tip part of one leg is cut from being mixed, and as a result, it is possible to prevent a case where an excellent engaging force is not obtained, a case where the engaging force varies, and a case where the appearance is deteriorated.

Further, in the flame-retardant hook-and-loop fastener of the present invention, since the base fabric is not waved in the up-and-down direction, even when the selvage parts are provided at both end parts along the warp yarn direction, the selvage parts do not meander, so that the central part thereof can be sewn with a sewing thread with good appearance.

Further, in the hook-and-loop fastener of the present invention, it is not necessary to apply a flame-retardant back coating resin liquid to the rear face of the base fabric of the hook-and-loop fastener as in the conventional hook-and-loop fastener, so that problems such as deterioration of the flexibility of the hook-and-loop fastener due to the back coating resin, lack of stability of the back coating resin liquid, and deterioration of the flame retardancy over time due to bleeding out of the flame-retardant added to the back coating resin liquid do not occur. Further, problems such as deterioration of the working environment due to solvent vapor or the like of the back coating resin liquid when the resin liquid is applied and dried, or a decrease in productivity due to the time and effort required for application and drying, do not occur.

BRIEF DESCRIPTION OF DRAWINGS

FIG. 1 is a view schematically showing an example of a heat treatment apparatus in [step B] preferably used in producing the flame-retardant hook-and-loop fastener of the present invention, and an example of an apparatus preferably used in [step C].

FIG. 2 is a view schematically showing a cross section in a plane parallel to the warp yarn of the base fabric when [step C] is performed in a preferable example of the flame-retardant hook-and-loop fastener of the present invention.

FIG. 3 is a view schematically showing a cross section in parallel to the warp yarn of the base fabric of the flame-retardant hook-and-loop fastener when [step C] is not performed.

DESCRIPTION OF EMBODIMENTS

Hereinafter, the present invention is explained in detail. First, the PPS-based hook-and-loop fastener of the present invention is roughly classified into three types: a hook hook-and-loop fastener in which only a hook-shaped engaging element is present on a front face of the base fabric, a loop hook-and-loop fastener in which only a loop-shaped engaging element is present on a front face of the base fabric, and a hook-and-loop coexisting type hook-and-loop fastener in which a hook-shaped engaging element and a loop-shaped engaging element coexist on a front face of the base fabric, and the present invention is intended for these 3 types of hook-and-loop fastener.

Among these, the hook hook-and-loop fastener is mainly formed of a monofilament yarn for a hook-shaped engaging element, a multifilament yarn for a warp yarn, and a multifilament for a weft yarn. Further, the loop hook-and-loop fastener is mainly formed of a multifilament yarn for a loop-shaped engaging element, a multifilament yarn for a warp yarn, and a multifilament yarn for a weft yarn. Moreover, the hook-and-loop coexisting type hook-and-loop fastener in which the hook-shaped engaging element and the loop-shaped engaging element coexist on the same front face is mainly formed of a monofilament yarn for the hook-shaped engaging element, a multifilament yarn for the loop-shaped engaging element, a multifilament yarn for a warp yarn, and a multifilament yarn for weft yarn.

Further, when necessary, a small amount of yarn other than the above-described yarn can be woven into the hook-and-loop fastener, or no yarn other than the above-described yarn can be woven thereinto.

In the present invention, both the warp yarn and the yarn for the engaging element are required to be yarns made of PPS-based resins because they impart excellent flame retardancy, are excellent in fiber physical properties and weaving properties, and further, can be bonded to a heat-fusible component by heat-fusion. Therefore, the PPS-based multifilament yarn is used for the warp yarn, the PPS-based multifilament yarn is used for the yarn for the loop-shaped engaging element, and the PPS-based monofilament yarn is used for the yarn for the hook-shaped engaging element. Further, in the present invention, a PPS-based multifilament yarn is used as a main yarn constituting the weft yarn in order to further enhance flame retardancy.

The PPS resin is a resin excellent in flame retardancy and heat resistance, and further excellent in fiber formability and fiber physical properties, and the PPS-based multifilament yarn and the PPS-based monofilament yarn used in the present invention are obtained from a PPS resin having a weight-average molecular weight of 20,000 to 100,000, that is, obtained by melt-spinning the PPS resin, stretching, and further performing a heat treatment as necessary. Various kinds of such PPS-based multifilament yarns and PPS-based monofilament yarns are commercially available at present, and yarns having a desired thickness and a desired number of bundled yarns are manufactured and provided by fiber makers in response to a request from a user. Further, the PPS-based multifilament yarn or monofilament yarn can contain a flame-retardant, a coloring agent, various stabilizers, and further, a small amount of other resin components as long as flame retardancy, fiber physical properties, and weaving properties are not impaired.

As the warp yarn used in the present invention, a PPS-made multifilament yarn having a total thickness of 150 to 350 decitex in which 24 to 90 PPS-based filaments having a thickness of 2 to 10 decitex are bundled is preferable for covering a surface of a multifilament yarn (hereinafter, referred to as a heat-fusible yarn in some cases) made of a heat-fusible and heat-shrinkable filament used as a part of the weft yarn, enhancing the bonding by the heat-fusible yarn, and further achieving higher flame retardancy. More preferably, it is a PPS-based multifilament yarn having a total thickness of 200 to 300 decitex in which 30 to 80 PPS-based filaments having a thickness of 3 to 8 decitex are bundled. Further, such a PPS-based multifilament yarn is preferably imparted with a twist of 100 to 800 T/m, and more preferably imparted with a twist of 300 to 600 T/m, from the viewpoint of weaving properties. Note that T/m is an abbreviation of turn/meter.

Further, the weft yarn is preferably a yarn made of a PPS-based multifilament yarn as a main component and a heat-fusible yarn, and particularly preferably a yarn obtained by paralleling these yarns. In particular, a paralleled yarn made of a PPS-based multifilament yarn having a total thickness of 120 to 300 decitex in which 5 to 90 PPS-based filaments having a thickness of 3 to 30 decitex are bundled and a multifilament yarn having a total thickness of 80 to 150 decitex in which 15 to 40 polyester-based core-sheath type filaments having a thickness of 3 to 8 decitex in which the sheath component is a heat-fusible component having a low melting point are bundled, in which the total decitex of the PPS-based multifilament yarn is larger than the total decitex of the heat-fusible yarn, is preferable.

Among these paralleled yarns, the case where the weft yarn is a paralleled yarn of a PPS-based multifilament yarn having a total thickness of 140 to 280 decitex in which 6 to 80 filaments having a thickness of 3.5 to 24 decitex are bundled and a multifilament yarn having a total thickness of 80 to 140 decitex in which 20 to 30 polyester-based core-sheath type filaments having a thickness of 3 to 6 decitex in which a sheath component is a heat-fusible component having a low melting point are bundled is particularly preferable.

In particular, when a plurality of narrow hook-and-loop fasteners is simultaneously produced by slitting after producing a wide hook-and-loop fastener, in order to prevent fraying from the slit portion, a paralleled yarn of a PPS-based multifilament yarn having a total thickness of 150 to 280 decitex in which 8 to 80 filaments having a thickness of 3.5 to 20 decitex are bundled and a multifilament yarn having a total thickness of 80 to 140 decitex in which 20 to 30 polyester-based core-sheath type filaments having a thickness of 3 to 6 decitex in which a sheath component is a heat-fusible component having a low melting point are bundled is preferably used as the weft yarn.

On the other hand, when a narrow or wide hook-and-loop fastener is produced directly from a weaving step without slitting, a paralleled yarn of a PPS-based multifilament yarn having a total thickness of 140 to 200 decitex in which 6 to 20 filaments having a thickness of 10 to 24 decitex are bundled and a multifilament yarn having a total thickness of 80 to 140 decitex in which 20 to 30 polyester-based core-sheath type filaments having a thickness of 3 to 6 decitex in which a sheath component is a heat-fusible component having a low melting point are bundled is preferably used as the weft yarn from the viewpoint of improvement in appearance quality.

Further, it is preferable that the heat-fusible yarn constituting a part of the weft yarn maintains the form of the yarn even after the heat-fusion from the viewpoint of the heat-fusing property and further from the viewpoint of the property of the hook-and-loop fastener after the heat-fusion. Therefore, the heat-fusible yarn is preferably a multifilament yarn made of a core-sheath type filament in which the heat-fusible component is a sheath component exposed to the surface of the fiber and a core component is not melted at the heat-fusion temperature. Then, the sheath component which is a part of the core-sheath type filament is melted at a temperature of 240° C. or lower, and the melt adheres and fixes the PPS-based yarn for the engaging element and warp yarn existing in the vicinity. The sheath component of the heat-fusible yarn is preferably a polyester-based resin from the viewpoint of adhesiveness to the PPS-based multifilament yarn or monofilament yarn, water absorption stability, thermal stability, yellowing resistance, and the like.

In particular, from the viewpoint of ease of handling and adhesiveness during heat-fusion, resistance to peeling between the core component and the sheath component and the like, a multifilament yarn made of filaments having a core-sheath cross section in which the sheath component is a polyester-based resin having a low melting point and the core component is a polyester-based resin having a high melting point that does not melt at the temperature at which the sheath component is heat-fused is preferable. Specifically, the sheath component is preferably a polyethylene terephthalate-based copolymer having a melting point of 220° C. or lower, particularly 120 to 210° C., obtained by copolymerizing a copolymerization component such as isophthalic acid, sulfoisophthalic acid, adipic acid, and propylene glycol.

In addition, the core component is preferably a polyester having a high melting point, specifically, a polyester which is not copolymerized or which is copolymerized but has a melting point higher than that of the sheath component resin by 50 to 120° C., such as a polyethylene terephthalate homopolymer or a polyethylene naphthalate homopolymer.

The cross-sectional shape of the core-sheath cross-sectional filament can be a single-core core-sheath or a multi-core core-sheath, and can be a concentric core-sheath or an eccentric core-sheath. It can also have a bimetallic cross-section. That is, the low-melting-point component can be exposed to the surface of the fiber. The weight ratio of the core component to the sheath component is preferably in the range of 75/25 to 30/70, and particularly preferably in the range of 80/20 to 55/45.

In particular, in the present invention, the heat-fusible yarn preferably has heat shrinkability in order to enhance the pull-out resistance of the engaging element, and specifically, a yarn having a dry-heat shrinkage percentage at 200° C. of 10 to 24% is used. More preferably, the dry-heat shrinkage percentage at 200° C. is 12 to 22%.

Furthermore, the PPS yarn used for the warp yarn, the yarn for the engaging element, and the weft yarn is also preferably heat-shrinkable from the viewpoint of the pull-out resistance of the engaging element. Specifically, the PPS-based multifilament yarn used for the warp yarn, the weft yarn, and the yarn for the loop-shaped engaging element preferably has a dry-heat shrinkage percentage at 200° C. of 3 to 15%, and the monofilament yarn used for the yarn for the hook-shaped engaging element preferably has a dry-heat shrinkage percentage of 1 to 4%.

Note that the dry-heat shrinkage percentage at 200° C. described herein is a value obtained by allowing a yarn of 50 cm to stand in a free state in an atmosphere at 200° C. for 1 minute and calculating the shrinkage percentage from the yarn shrunk after standing for 1 minute, and is a measurement average value of 10 yarns arbitrarily selected.

Further, the weight ratio of the PPS-based multifilament yarn and the heat-fusible yarn constituting the weft yarn is preferably in the range of 80:20 to 52:48, and more preferably in the range of 75:25 to 55:45, from the viewpoint of achieving both flame retardancy and fixation of the engaging element. In particular, when a plurality of narrow hook-and-loop fasteners is simultaneously produced by slitting after a wide hook-and-loop fastener is produced, it is preferably in the range of 75:25 to 60:40, and when a narrow or wide hook-and-loop fastener is produced directly from a weaving step without slitting, it is preferably in the range of 70:30 to 55:45.

The yarn made of the PPS-based multifilament yarn and the heat-fusible yarn thus-used as the weft yarn is preferably in a condition of a so-called non-twisted yarn having a twist number of 0 to 80 T/m because the heat-fusible resin of the sheath component can effectively function to firmly fix the yarn for the engaging element.

In the present invention, note that the warp yarn, the weft yarn, and the yarn for the engaging element can contain a small amount of other filaments as long as the flame retardancy and engaging force of the hook-and-loop fastener and the properties after long-term storage under a high-temperature and high-humidity condition are not impaired.

Further, the PPS-based monofilament yarn used for the hook-shaped engaging element is preferably a monofilament yarn made of a PPS-based resin and having a diameters of 150 to 250 μm, more preferably a monofilament yarn having a diameter of 180 to 220 μm, and particularly preferably a monofilament yarn having a diameter of 195 to 210 μm, in terms of engaging force, and further because the hook shape is not stretched even when engagement and peeling are repeated.

Further, the PPS-based multifilament yarn used as the loop-shaped engaging element is preferably a PPS-based multifilament yarn also made of a PPS-based resin and having a total thickness of 200 to 500 decitex in which 8 to 30 filaments having a thickness of 8 to 30 decitex are bundled, and particularly preferably a PPS-based multifilament yarn having a total thickness of 250 to 450 decitex in which 16 to 24 filaments having a thickness of 12 to 20 decitex are bundled, in terms of the engaging force, and further, because the engaging element is hardly cut by the repetition of engagement and peeling, and furthermore, because the touch feeling of the front face of the hook-and-loop fastener is gentle, and the like.

In a general hook-and-loop fastener, a multifilament yarn made of 8 to 15 filaments is usually used as the yarn for the the loop-shaped engaging element, but in the flame-retardant hook-and-loop fastener of the present invention, a multifilament yarn having a larger number of filaments compared thereto is preferably used as the yarn for the the loop-shaped engaging element, whereby the front face of the base fabric can be densely covered with the PPS-based loop-shaped engaging element, and as a result, the flame retardancy can be further enhanced. Further, the yarn for the the loop-shaped engaging element is preferably a non-twisted multifilament yarn in which the twist is not provided, in order to improve the engaging force by loosening of the multifilament yarn when the engaging element is formed.

From such warp yarn, weft yarn, and yarn for the engaging element, a woven-fabric-based flame-retardant hook-and-loop fastener is produced by sequentially performing the above-described steps A to D. Next, a method for producing a woven-fabric-based flame-retardant hook-and-loop fastener is described in the order of steps.

First, a woven-fabric having a large number of loops for engaging elements on a front face thereof is woven by the following step A.

[step A] a step of, at a time of weaving the base fabric from the warp yarn and the weft yarn, weaving the yarn for the engaging element into the warp yarn in parallel, and at the same time, allowing the yarn for the engaging element to regularly run over the warp yarn, and raising the yarn for the engaging element in a loop shape from the of the front face of the base fabric at a running-over position to weave a loop woven-fabric;

When the loop woven-fabric is woven in the step A, a woven structure is preferably a plain weave in which the monofilament yarn for the hook-shaped engaging element and the multifilament yarn for the loop-shaped engaging element are used as a part of the warp yarn, and these yarns for the engaging elements are woven in parallel to the warp yarn, alternately run over and under three threads of the weft yarn and rise from the front face of the base fabric. In the case of the hook hook-and-loop fastener, a woven structure in which the yarns for the engaging elements run over one to three threads of the warp yarn while forming a loop, and further, crawl in between the warp yarns and alternately run over and under three threads of the weft yarn is preferable since one leg of the loop for hook engaging element is then easily cut in an efficient manner, and further, in the case of the loop hook-and-loop fastener, a woven structure in which the yarns for the engaging elements run over one thread of the warp yarn while forming a loop and crawl into between the threads of the warp yarn is preferable since the engaging element is easily fixed to the base fabric. In particular, a woven structure in which a loop for the hook-shaped engaging element and a loop for the loop-shaped engaging element both alternately run over and under three threads of the weft yarn and float while forming a loop, run over one thread of the warp yarn, and crawl into between the threads of the warp yarn is preferable since the engaging element has excellent pull-out resistance, the engaging element easily stand up in the same direction, and a higher engaging force is obtained.

In general, there is adopted that, in the case of a hook hook-and-loop fastener, the yarn for the hook-shaped engaging element run over two to three threads of the warp yarn to form a loop for forming the hook-shaped engaging element at that position, and in the case of a loop hook-and-loop fastener, a loop is formed without running over the warp yarn, from the viewpoint of ease of production and ease of engagement between the hook-shaped engaging element and the loop-shaped engaging element. However, in the present invention, it is preferable to use a method of forming a loop at a position where the hook-shaped engaging element and the loop-shaped engaging element both run over one thread of the warp yarn, which is different from such a general running-over method.

The same applies to the case of the hook-and-loop coexisting type hook-and-loop fastener, and it is preferable that the yarn for the hook-shaped engaging element and the yarn for the the loop-shaped engaging element are each threaded into between the threads of the warp yarn such that two threads adjacent to each other with a plurality of threads of the warp yarn interposed therebetween both become the same yarn for the engaging element. Further, in this case, the ratio of the number of threads of the monofilament yarn for the hook-shaped engaging element to the multifilament yarn for the loop-shaped engaging element is preferably in the range of 40:60 to 60:40.

The weave density of the woven-fabric is preferably 50 to 90 threads/cm for the warp yarn (including the yarn for the engaging element), particularly preferably 55 to 80 threads/cm for the warp yarn, and preferably 10 to 30 threads/cm for the weft yarn, and particularly preferably 12 to 24 threads/cm for the weft yarn. Further, the proportion of the heat-fusible yarn in the entire hook-and-loop fastener is preferably 5 to 15% by weight, particularly preferably 6 to 10% by weight, from the viewpoint of achieving both flame retardancy and pull-out resistance of the engaging element.

Further, the height of the hook-shaped engaging element of the hook-and-loop fastener is preferably from 1.2 to 2.0 mm from the face of the base fabric, and the height of the loop-shaped engaging element is preferably from 1.9 to 3.0 mm from the face of the base fabric, from the viewpoint of engaging force and further from the viewpoint of resistance to the falling down of the engaging element.

Further, the density of the hook-shaped engaging element of the hook hook-and-loop fastener, the density of the loop-shaped engaging element of the loop hook-and-loop fastener, and the total density of the hook-shaped engaging element and the loop-shaped engaging element of the hook-and-loop coexisting type hook-and-loop fastener are preferably 40 to 80/cm$^2$, 40 to 80/cm$^2$, and 40 to 80/cm$^2$, respectively, on the basis of the base fabric portion where the engaging element is present and on the basis of the area after heat shrinkage, and particularly preferably 45 to 75/cm$^2$, 45 to 75/cm$^2$, and 45 to 75/cm$^2$, respectively, which the front face of the hook-and-loop fastener is covered with a large number of PPS-based engaging elements, in the viewpoint of enhancing the flame retardancy. Further, in the hook-and-loop coexisting type hook-and-loop fastener, the ratio of the number of the hook-shaped engaging element to the number of the loop-shaped engaging element is preferably in the range of 40:60 to 60:40.

Note that when forming a loop for the hook-shaped engaging elements, in order to facilitate the formation of the loops for the hook-shaped engaging elements having uniform heights, it is preferable to use a method in which metal rods having a uniform longitudinal cross section are arranged and placed in the same number as the number of threads of the yarn for the hook-shaped engaging element such that the cross section is in the height direction parallel to the warp yarn at positions at which the yarn for the hook-shaped engaging element runs over the warp yarn, loops having the same shape are formed by passing the yarns for the engaging element over the upper part of the metal rods, and the metal rods are pulled out from the loops after loop formation.

Note that, in the above-described step A, an area for the selvage part in which no loop for the engaging element is present on a surface can be provided at both end parts along the warp yarn direction of the loop woven-fabric, and further, an area for the selvage part (area for an intermediate selvage) in which no loop for the engaging element is present on a surface can be provided at the parts other than both end parts. Since the present invention is particularly preferable for the production of a wide hook-and-loop fastener, it is preferably used in a method including: first weaving the loop woven-fabric in which the engagement element area and the area for the selvage part are each continuously present in the warp yarn direction and the engaging element area and the area for the selvage part are alternately present, and further a plurality of areas for the engaging element is present in the weft yarn direction on the front face of the wide loop woven-fabric; and after the step D, slitting a center of the area for the selvage part in the warp yarn direction to simultaneously produce the hook-and-loop fastener having the selvage parts (at least one of the selvage parts is formed of the area for the intermediate selvage) on a plurality of both end parts that is continuous in the warp yarn direction of the hook-and-loop fastener.

The width of the engaging element area having the selvage part is preferably 10 to 50 mm, the width of the area for the selvage part provided at both end parts is preferably 1.5 to 4 mm, and in the case of the area for the intermediate selvage, the width of the selvage part area is preferably 3 to 8 mm. Further, when a plurality of hook-and-loop fasteners is simultaneously produced by slitting the area for the intermediate selvage of the wide hook-and-loop fastener, the number of the narrow hook-and-loop fasteners obtained by slitting is preferably 2 to 10, and the width of the hook-and-loop fastener before slitting is preferably 50 to 300 mm.

In the case of providing the area for the intermediate selvage, a method for simultaneously obtaining the narrow hook-and-loop fastener tapes by slitting the central part of the area for the intermediate selvage after the step D is used, in the case of the flame-retardant hook-and-loop fastener of the present invention, since there is almost no waving in the up-and-down direction, the central part of the area for the intermediate selvage can be accurately slit, and at the same time, a plurality of hook-and-loop fasteners in which selvage parts having constant widths continue in a straight line without meandering in the warp yarn direction at both end parts can be obtained simultaneously.

The loop woven-fabric for the hook-and-loop fastener thus obtained is then sent to the following step B and subjected to a heat treatment for melting the heat-fusible component as the sheath component of the heat-fusible yarn.

[step B] a step of guiding the loop woven-fabric obtained in the step A to a heating region, heating at a temperature equal to or higher than a temperature at which the heat-fusible component of the heat-fusible yarn is melted, heat-shrinking the heat-fusible yarn, and fixing a rising part of the loop made of the yarn for the engaging element to the base fabric by a melt from the heat-fusible yarn;

Preferably, as shown in FIG. 1, the heat treatment is performed such that the loop woven-fabric produced in the step A continuously runs in the heat treatment furnace (3) in a long state, following the step A without winding the loop woven-fabric in the middle. By this heat treatment, the sheath component of the heat-fusible yarn constituting the weft yarn is melted and simultaneously shrunk to fix the monofilament yarn and the multifilament yarn for the engaging element to the base fabric. Further, it is preferable that the long woven-fabric for the hook-and-loop fastener running in the heat treatment furnace is allowed to run without applying much tensile force in the width direction so as to allow sufficient shrinkage.

By this, an application and drying treatment of the back coating adhesive, which has been performed in conventional the woven-fabric-based hook-and-loop fastener, is not necessary, and the above-described problems in the process and properties due to the back coating adhesive can be prevented. Further, the loop shape of the hook-shaped engaging element is fixed by heat at the time of the heat treatment, and even after one leg of the loop for the hook-shaped engaging element is cut to form the hook-shaped engaging element in the subsequent step D, the hook shape is maintained and sufficient engagement strength can be obtained. Also, in the case of the loop-shaped engaging element, the loop shape becomes a natural and unified shape due to heat at the time of this heat treatment.

The temperature at the time of the heat treatment step B used is a temperature at which the heat-fusible component constituting the weft yarn is melted or soften but other components or yarns are not melted, and at which the monofilament yarn for the hook-shaped engaging element is fixed in a loop shape, which is 230 to 260° C., and more preferably in the range of 240 to 258° C. Such a heat treatment is usually performed by running the woven-fabric for the hook-and-loop fastener in a heated furnace. Specifically, the heat treatment is completed by running so as to stay in the heating furnace for 20 to 120 seconds at a speed of 0.30 to 1.30 m/minute.

Thus, the following step C is performed next on the loop woven-fabric in which the heat-fusible component of the heat-fusible yarn has been melted and the melted resin has penetrated into the adjacent yarn.

[step C] a step of taking out the loop woven-fabric from the heating region of the step B and sliding a rear face of the base fabric on a fixed surface or a roll surface while pressing the rear face against the fixed surface or the roll surface in a state where the heat-fusible component of the heat-fusible yarn is melted;

That is, as shown in FIG. 1, when the woven-fabric for the hook-and-loop fastener subjected to the heat treatment in the step B comes out from the heat treatment furnace (3), the rear face of the base fabric (1) is slid on the fixed surface or the roll surface (4) while being pressed against the fixed surface or the roll surface in a state in which the heat-fusible component of the heat-fusible yarn is kept molten. FIG. 1 shows a case where the woven-fabric for the hook-and-loop fastener (1) is slid on the fixed surface (4) while pressing the rear face against the fixed surface immediately after the woven-fabric leaves the heat treatment furnace (3).

By this step C, the waving in the up-and-down direction of the hook-and-loop fastener can be solved, and as a result, a wide, flat, and flame-retardant hook-and-loop fastener with almost no waving can be obtained. Further, by this step, the engaging element can be further prevented from being pulled out from the base fabric even when the engagement and peeling are repeated. That is, by this step, the yarns constituting the base fabric are pressure-bonded to each other, and the heat-fusible component extruded by the pressure-bonding penetrates into the adjacent yarn to further increase the bonding force, so that the engaging element is firmly fixed to the base fabric, whereby the proportion of the heat-fusible component can be reduced. As a result, the engaging element can be prevented from being pulled out from the base fabric in spite of a small amount of the heat-fusible component, and at the same time, regarding the flame retardancy, the proportion of the heat-fusible component impairing the flame retardancy can be reduced, to obtain a hook-and-loop fastener excellent in flame retardancy.

In the present invention, since the PPS-based yarn used as the warp yarn, the yarn for the engaging element, or a part of the weft yarn is much more rigid compared to a yarn made of ordinary synthetic fiber, the above effect is hardly exhibited only by pressing the rear face of the loop woven-fabric made of such a yarn against a fixed surface or a roll surface. However, the above effect can be highly exhibited by performing the step C by a method of sliding the loop woven-fabric on the fixed surface or the roll surface while pressing it against the fixed surface or the roll surface. That is, in the case of the PPS-based hook-and-loop fastener, even when the loop woven-fabric is brought in contact with the surface of the roll rolling at the same surface speed as the running speed of the woven-fabric, the woven-fabric does not slide on the surface, and thus, the the effect cannot be expected.

That is, it is necessary to satisfy all of pressing the rear face of the loop woven-fabric against the fixed surface or the roll surface, preventing the loop for engaging element existing on a face opposite to the face to be pressed from being pushed down by the operation, and further, sliding the running loop woven-fabric on the fixed surface (4) or the roll surface rolling at a surface speed different from the running speed of the loop woven-fabric (1).

In this way, the filaments constituting the warp yarn are promoted to move to a stable position by running on the fixed surface or the roll surface while sliding on and being pressed against on the fixed surface or the roll surface, and accordingly, the weft yarn settles to a natural state and a shrinkage state is uniformized. As a result, the strain is solved and the squeezing out of the heat-fusible component from the weft yarn is promoted. Then, by running and sliding it on the fixed surface or the roll surface while being pressed against such a fixed surface or roll surface, the thickness of the warp yarn, which alternately runs over and under the weft yarn with the weft yarn interposed therebetween, in the base fabric thickness direction at the position at which the warp yarn subducts most toward the rear face side, which is described later, satisfies 0.94 times or less of the thickness of the warp yarn in the base fabric thickness direction at the position at which the warp yarn floats most toward the front face side.

Furthermore, in order to achieve such a state, as described later, it is preferable to set the tensile force applied to the loop woven-fabric to about 50 to 600 g/cm while changing the running direction of the loop woven-fabric after contacting with the fixed surface or the roll surface. More preferably, a tensile force of about 100 to 400 g/cm is applied.

Further, in the present invention, preferably, the step C is performed by a method of changing the running direction while pressing the loop woven-fabric against the fixed surface or the roll surface and sliding it on the fixed surface or the roll surface, and by changing the running direction, pressing it against the fixed surface or the roll surface is easily performed and the effect of pressing and sliding is improved.

Further, the step C is preferably carried out without once cooling the loop woven-fabric taken out from the step B at the time when the loop woven-fabric is still kept in a high temperature state due to heat applied in the step B following the step B, that is, by utilizing the residual heat of the step B. Even when the loop woven-fabric is once cooled after passing through the step B and then reheated, a certain degree of effect can be expected, but the strain of the loop woven-fabric once cooled and fixed is hardly solved, and the sufficient effect of the present invention is hardly obtained. Therefore, step C is preferably carried out in the vicinity of the place where step B is carried out, immediately after the woven-fabric for the hook-and-loop fastener comes out from the step B.

Further, it is preferable that, until the rear face of the loop woven-fabric for the hook-and-loop fastener sent to this step is pressed against the fixed surface or the roll surface (4) after entering heat treatment furnace (3), the front face and the rear face do not bring in contact with any solid object such as a roller or a guide, and the fixed surface or the roll surface is the first contact object.

In the present invention, as the fixed surface or the roll surface (4) used in the step C, a surface having a contact length with the rear face of the base fabric of 20 to 100 mm and a contact time of 2 to 10 seconds is preferable, and specific examples of the surface include a fixed surface or a roll surface made of metals, ceramics, or heat-resistant resins, as preferable materials. The front face of the fixed surface or the roll surface can be a mirror-finished state, a satin-finished state, or slightly uneven as long as the rear face of the loop woven-fabric can be pressed and the rear face of the loop woven-fabric can be slid. Further, the running speed at the time of sliding on the fixed surface or the roll surface (4) is preferably 5 to 22 mm/second.

When the roll surface is used in the step C, as described above, it is preferable that a difference is provided between the surface speed of the roll and the running speed of the loop woven-fabric running while being pressed against the surface, and the loop woven-fabric is allowed to run while sliding on the surface. At this time, the speed difference between the surface speed of the roll and the loop woven-fabric running on the roll surface is preferably 10 to 100 mm/second.

In addition, as shown in FIG. 1, it is preferable that the rear face of the woven-fabric has a shape in which the running direction is changed by 30 to 180° along the fixed surface, since the effect is particularly easily obtained. In FIG. 1, the woven-fabric for the hook-and-loop fastener (1) changes its running method by 90° along the fixed surface (4).

Note that the fixed surface or the roll surface (4) is preferably heated to a temperature lower than the heat treatment temperature by 80 to 180° C. in order to enhance the contact effect. However, in general, the surface of the fixed surface or the roll surface (4) can be heated by residual heat of the base fabric (1) coming out from the heat treatment furnace. The surface against which the rear face of the base fabric is pressed can be any of a surface in which the surface is fixed, a roll surface whose contact surface rolls at a surface speed different from the speed of the base fabric as the base fabric runs, or a roll surface with drive which actively pulls the base fabric and which rolls at the surface speed different from the speed of the base fabric. However, in the case of the roll surface, as described above, it is necessary to slide the rear face of the loop woven-fabric on the roll surface while difference is provided between the surface speed of the roll and the running speed of the loop woven-fabric running while being pressed against the surface, and the structure is simple and the effect is surely easily obtained, thus, the fixed surface as shown in FIG. 1 is preferably used. Further, it can also be a guide-shaped narrow surface, but is preferably a fixed surface having a contact length as described above.

In the present invention, as shown in FIG. 1, the base fabric (1) is passed through the heat treatment furnace (3), the weft yarn is shrunk by the heat treatment furnace (3) as described above, then it comes out from the heat treatment furnace (3), and it is continuously run on the fixed surface (4), whereby the base fabric (1) is in a tensioned state in the warp yarn direction in a state of being press-bonded to the fixed surface or the roll surface (4). In order to enhance the effect, it is preferable that the tensile force applied to the base fabric immediately after passing through the surface on which the base fabric is fixed (4) is about 50 to 600 g/cm. More preferably, a tensile force of about 100 to 400 g/cm is applied.

In the case of the woven-fabric-based hook-and-loop fastener of the present invention, the warp yarn alternately runs over and under the weft yarn interposed therebetween, and therefore, the rear face of the base fabric is in a state of being covered with the warp yarn, and therefore, the weft yarn in which the heat-fusible component is present is hardly brought in direct contact with the fixed surface or the roll surface (4). Therefore, the melt of the heat-fusible component does not adhere directly to the surface of the fixed surface or the roll surface (4), whereby the occurrence of the trouble is hardly caused.

The operation of sliding the woven-fabric for the hook-and-loop fastener (1) while pressing the rear face against the fixed surface or the roll surface (4) in a state where the heat-fusible component constituting the weft yarn is melted is preferably carried out, as described above, by utilizing the residual heat at the time of the heat treatment so as to be continued to the heat treatment in the heat treatment furnace (3) as shown in FIG. 1 without once cooling the woven-fabric for the hook-and-loop fastener heat-treated in the step B, in terms of enhancing the effect of the invention and productivity. However, after the woven-fabric for the hook-and-loop fastener is taken out from the heat treatment furnace (3) and once cooled, the rear face side of the base fabric is reheated to be in a state where the heat-fusible component of the weft yarn at the rear face side of the woven-fabric for the hook-and-loop fastener is melted, and the operation of pressing against the fixed face or the roll face (4) can be performed in this state, but the effect to be obtained is low.

By performing the operation [step C] of pressing the rear face of the base fabric (1) against the fixed surface or the roll surface (4) while sliding it on the surface in a state where the heat-fusible component is melted, as shown in FIG. 2, the thickness (Tb) of the warp yarn in the base fabric thickness direction at the position at which the warp yarn, which alternately runs over and under the weft yarn with the weft yarn interposed therebetween, subducts most toward a rear face side is 0.94 times or less of the thickness (Ts) of the warp yarn in the base fabric thickness direction at the position at which the warp yarn floats most toward a front face side. In particular, as described above, by running and sliding it on the fixed surface while pressing it against the fixed surface, and changing the running direction, it is preferable to satisfy that the thickness of the warp yarn, which alternately runs over and under the weft yarn with the weft yarn interposed therebetween, in the base fabric thickness direction at the position at which the warp yarn subducts most toward the rear face side is 0.90 times or less of the thickness of the warp yarn in the base fabric thickness direction at the position at which the warp yarn floats most toward the front face side. Note that, in FIGS. 2 and 3, K indicates the base fabric thickness direction.

However, when (Tb) is too low, the rear face of the hook-and-loop fastener base fabric is densely flattened by heat-fusion, and the flexibility and texture, which are advantages of the base fabric as the woven-fabric, and further, the air permeability and liquid permeability are impaired, which is not preferable. Therefore, (Tb) is preferably 0.7 times or more, and particularly preferably 0.75 times or more, of (Ts).

FIG. 2 schematically shows a cross-sectional state of the woven-fabric hook-and-loop fastener where the effect of the present invention can be obtained by performing an operation of sliding the rear face of the base fabric (1) on the fixed surface or the roll surface (4) in a state where the heat-fusible component is melted while pressing it against the fixed surface or the roll surface, that is, the case where (Tb) is 0.94 times or less of (Ts) (hereinafter, sometimes expressed by (Tb)/(Ts) ratio or the ratio of (Tb) and (Ts)). On the other hand, FIG. 3 is a view schematically showing the cross-sectional state of the woven-fabric hook-and-loop fastener when the operation of pressing the rear face of the base fabric (1) against the fixed surface or the roll surface (4) in a state where the heat-fusible component is melted is not performed. In this case, (Tb) has substantially the same value as (Ts), and the above-mentioned (Tb)/(Ts) ratio does not satisfy 0.94 or less.

Note that, even when the operation of sliding the rear face of the base fabric on the fixed surface or the roll surface while pressing it against the fixed surface or the roll surface in a state where the heat-fusible component is melted, that is, [step C], is not performed, a phenomenon in which the value of (Tb) becomes slightly smaller than the value of (Ts) due to the natural gravity applied on the book-and-loop fastener during the manufacturing process of the hook-and-loop fastener woven-fabric can occur. However, the decrease is extremely slight, and (Tb) does not fall below 0.96 times (Ts).

Next, a method for measuring (Tb) and (Ts) of warp yarn, which alternately runs over and under the weft yarn with the weft yarn interposed therebetween, is described.

First, an area on the front face on which the engaging element is present and which is less affected by the engaging element is selected, and the hook-and-loop fastener is cut in parallel to the warp yarn so as to cut the central part of the bulge of the warp yarn using a safety razor blade for shaving as a cutting apparatus. The resulting cross section is photographed with 200 times magnification. FIG. 2 schematically shows a photograph of the cut part obtained as a result. From this photograph, three points where the warp yarn subducts most toward the rear face side are arbitrarily selected, three points where the warp yarn floats most toward the front face side are also arbitrarily selected, and the thicknesses in the base fabric thickness direction at the respective points is measured. The same measurement is performed at arbitrary 10 points of the hook-and-loop fastener, and the thicknesses in the base fabric thickness direction at the respective points is measured. Among the 30 measured values of the thicknesses in the base fabric thickness direction at the point where the warp yarn subducts most toward the rear face side and the 30 measured values of the thicknesses in the base fabric thickness direction at the point where the warp yarn floats most toward the front face side, 5 measured valued in order from the highest value and 5 measured value in order from the lowest value are removed, and the average value of the remaining 20 values is obtained. The obtained average values are each the thickness (Tb) of the warp yarn in the base fabric thickness direction at the position where the warp yarn subducts most toward the rear face side and the thickness (Ts) of the warp yarn in the base fabric thickness direction at the position where the warp yarn floats most toward the front face side.

Note that even when the hook-and-loop fastener woven-fabric is pressed against the fixed surface or the roll surface at the time when the heat-fusible component of the weft yarn is kept in a molten state, not all the positions of the warp yarn present on the rear face of the hook-and-loop fastener woven-fabric, which is subducted most toward a rear face side, are pressed against the fixed surface or the roll surface. Among these, there sometimes exists a position where the thickness (Tb) of the rear face side of the warp yarn is hardly different from the thickness (Ts) of the front face side without being pressed against the fixed surface or the roll surface. However, in the present invention, such a position is also included in the arbitrarily selected positions. Therefore, it can be said that the (Tb)/(Ts) ratio specified in the present invention is an average value obtained including these positions.

On the other hand, FIG. 3 is a view in the case where the hook-and-loop fastener woven-fabric is not pressed against the fixed surface or the roll surface as described above. In the case of FIG. 3, that is, in the case where (Tb) and (Ts) are substantially the same value, the effect obtained by using the step C, that is, the effect of reducing the occurrence of the waving of the hook-and-loop fastener in the up-and-down direction or the like and the effect of highly preventing the engaging element from being pulled out from the base fabric by the repetition of the engagement and peeling, cannot be obtained.

In the present invention, the ratio of (Tb) to (Ts) depends mainly on the pressing strength at the time of pressing the hook-and-loop fastener base fabric against the fixed surface or the roll surface while sliding it, and therefore the value can be freely changed by running and sliding the hook-and-loop fastener base fabric on the fixed surface or the roll surface in a state with the tensile force applied, and changing the running direction along the fixed surface or the roll surface, as shown in FIG. 1.

Note that in the present invention, when the rear face of the hook-and-loop fastener base fabric is pressed against the fixed surface or the roll surface at the time when the heat-fusible component constituting the weft yarn is kept in a molten state, it is necessary that the front face side of the hook-and-loop fastener where the loop for the engaging element of the hook-and-loop fastener is present is not pressed against the fixed surface or the roll surface. That is, when an operation that the hook-and-loop fastener base fabric is sandwiched between rolls and the hook-and-loop fastener base fabric is pressed from above and below is performed, the loop for engaging element standing upright on the front face of the base fabric is pushed down by the pressing from above and fixed to the front face of the base fabric in this state, so that the engaging ability as the hook-and-loop fastener is reduced and the appearance of the hook-and-loop fastener is also deteriorated. Further, when both of the front face side and the rear face side of the hook-and-loop fastener base fabric are pressed against the fixed surface or the roll surface, (Tb) and (Ts) become substantially equal to each other, and the (Tb)/(Ts) ratio defined in the present invention cannot satisfy 0.94 or less.

Next, in the case where the loop for engaging element is a loop for a hook-shaped engaging element, the thus-obtained woven-fabric having the loop for the engaging element on the front face is sent to the following step D, and one leg of the loop for the hook-shaped engaging element is cut to form a hook-shaped engaging element.

[step D] a step of taking out the loop woven-fabric from the step C, cooling the loop woven-fabric, and then cutting one leg of the loop to form the hook-shaped engaging element from the loop when the yarn for the engaging element is a monofilament yarn.

The cutting apparatus used for this purpose is preferably a cutting apparatus having a structure for cutting one leg of the loop for the hook-shaped engaging element of the base fabric for the hook hook-and-loop fastener running in the warp yarn direction or the base fabric for the hook-and-loop coexisting type hook-and-loop fastener by reciprocating motion of a movable cutting blade between two fixed blades. The woven-fabric in which the one leg of the loop for the hook-shaped engaging element is cut is used as a hook hook-and-loop fastener or a hook-and-loop coexisting type hook-and-loop fastener.

Further, since the base fabric of the loop woven-fabric coming out from the step C is not waved in the up-and-down direction, one leg of the loops for the hook-shaped engaging elements can be surely cut at a position substantially the same height in the next step D. Therefore, it is possible to prevent the formation of both legs that are not cut and both legs that are cut, the mixture of one leg that is cut in the vicinity of the base and one leg that is cut in the vicinity of the tip part, and the like, thereby preventing the engaging force from varying and preventing the appearance of the hook-and-loop fastener from deteriorating.

According to the present invention, a flame-retardant woven-fabric hook-and-loop fastener excellent in resistance for pulling-out of the engaging element from the base fabric by repetition of engagement and peeling can be obtained in spite of a small proportion of the heat-fusible yarn which impairs flame retardancy. Particularly in the case where the engaging element is a hook-shaped engaging element, although it is difficult to achieve the pull-out resistance of the hook-shaped engaging element without impairing the flame retardancy, according to the present invention, the pull-out resistance, which is the pull-out force of the hook-shaped engaging element from the base fabric of 5 N or more, can be obtained.

Further, in the conventional flame-retardant hook-and-loop fastener, it has been difficult to produce a wide flame-retardant hook-and-loop fastener having a commercial value due to lack of flexibility or the like when a back coating resin layer is present on a rear face, or due to formation of a waving in the up-and-down direction by heat-fusion treatment when a heat-fusible and heat-shrinkable yarn is used in the weft yarn to impart the pull-out resistance of the engaging element, but according to the present invention, it is possible to obtain a hook-and-loop fastener which is wide, has no waving in the up-and-down direction, and has a flat front face.

In particular, the present invention is suitable for production of a hook-and-loop fastener having a width in the weft yarn direction of 15 to 200 mm and having no waving in the up-and-down direction. Further, according to the present invention, it is possible to obtain a flame-retardant hook-and-loop fastener with selvage parts in which selvage parts which has a constant width and in which no engaging element is present on both sides are present in a straight line without meandering in the warp yarn direction. Further, the present invention is also suitable for a method for simultaneously producing a plurality of narrow hook-and-loop fasteners by first producing a wide hook-and-loop fastener having a width of, for example, 50 to 300 mm, and finally slitting it in the warp yarn direction. In this case, it is also suitable for a method including: in the above-described step A, weaving the loop woven-fabric in which, on the front face of the loop woven-fabric, each of the engaging element area where the loop for the engaging element is present and the area for the selvage part where the loop for the engaging element is not present is continuously present in the warp yarn direction, and the engaging element area and the area for the selvage part are ultimately present, and further, a plurality of the engagement element areas are present, in a weft yarn direction; and after the above-described step D, slitting a center of the area for the selvage part in the warp yarn direction to simultaneously produce a plurality of the hook-and-loop fasteners having the selvage parts with the uniform width on both sides. The hook-and-loop fastener in which the selvage part is continuously present in a straight line without meandering in the warp yarn direction can be obtained. Of course, even in the case of the hook-and-loop fastener having a width of 15 mm or less, according to the present invention, it is possible to obtain a hook-and-loop fastener in which the engaging element is less likely to be pulled out from the base fabric even when engagement and peeling are repeated, the waving in the up-and-down direction hardly occurs in the hook-and-loop fastener, the selvage parts at both end parts do not meander, and the cut heights of one leg of the hook-shaped engaging element do not vary.

Further, in the present invention, it is preferable to continuously perform the step A to the end of the step D without winding the woven-fabric in the middle, because the effect of the present invention can be easily obtained, further, from the viewpoint of productivity, and because the hook-and-loop fastener having the hook shape or the loop shape of the engaging elements with the same shape can be easily obtained. That is, in the case of the conventional woven-fabric hook-and-loop fastener, since it takes time to perform steps including applying the back coating resin liquid to the rear face of the base fabric and drying the back coating resin liquid, it is necessary to wind the woven-fabric once before the application of the back coating resin liquid and wind it again when the back coating resin liquid is dried. However, this is not necessary in the present invention, and it can be said that productivity is extremely excellent.

Further, when winding in the middle of the step is performed, the loop for the engaging element falls down by winding, the shape of the loop for the engaging element is crushed, or the engaging element sinks into the base fabric by pressing the loop for the engaging element from above, which exerts an adverse influence even after passing through the step D. However, in the present invention, running at the same speed from the step A to step D is possible, and as a result, it is not necessary to wind it in the middle, and therefore, the above-described adverse influence can be prevented. Further, when it is wound many times in the middle of the production, a loss is inevitably generated at the start of the winding or the end of the winding, and the yield is lowered. However, in the present invention, since there is no winding in the middle, reducing of the yield is alleviated.

The woven-fabric-based hook-and-loop fastener made of PPS thus obtained is a white hook-and-loop fastener having a slightly brownish color due to the influence of the PPS yarn. Since the hook-and-loop fastener is often used in industrial application fields where it is away from people's sight or the color tone of the hook-and-loop fastener is not a concern, it is not necessary to purposely dye with a dye, a pigment, or the like. However, when it is used in applications where it come under people's observation, it can be dyed with a disperse dye and used in response to a user's request. In general, since PPS-based fiber products are difficult to dye, it is also difficult to dye the hook-and-loop fastener of the present invention in a deep color, but it is possible to obtain a product having a certain degree of deep color by dyeing using a disperse dye as a dye with water as a medium at high temperature and high pressure.

When dying using the disperse dye as a dye with water as a medium at high temperature and high pressure is performed, by performing a dyeing treatment of the hook-and-loop fastener of the present invention in an aqueous solution containing a disperse dye at a temperature in the range of 120 to 145° C. for 90 minutes or more, a PPS-based hook-and-loop fastener dyed in a deep color to some extent can be obtained. The kind of the disperse dye to be used is not particularly limited, and any disperse dye conventionally used for dyeing polyester fiber products can be used, and examples thereof include disperse dyes of aminoazobenzene-based, anthraquinone-based, and nitroarylamine-based such as nitrodiphenylamine derivatives. In particular, since PPS fiber products are used for heat-resistant applications and flame-retardant applications, a black-based disperse dye that can provide a color tone required for products for these applications is preferable.

The woven-fabric-based hook-and-loop fastener made of PPS obtained by the method described above in detail is suitable for applications requiring flame retardancy and heat resistance at a high level, for example, suitable for interior materials and materials for seats of vehicles such as automobiles, airplanes, trains, and ships, and mounting materials for curtains and the like, particularly, suitable for locking materials for fixing cushion bodies and skin materials of seats of these vehicles, and further, fixing materials for carpets for floors of the vehicles and mounting materials for curtains, and furthermore, suitable for the field of special clothes such as working clothes at a high-temperature site such as blast furnaces, foundries and glass product factories and fire-fighting clothes, and further suitable for a fixing material in a field requiring flame retardancy and heat resistance such as a filter fixing material for a high-temperature gas.

EXAMPLE

Hereinafter, the present invention is specifically described by way of Examples and Comparative Examples. Note that in the Examples and Comparative Examples, the flame retardancy was measured according to the vertical flame retardancy test method [14 CFR PART25 Sec25. 853 (a)]. Specifically, the sample was attached to a U-shape type jig in a flammability tester such that the exposed surface of the hook-and-loop fastener had a size of 5.08 cm×30.48 cm, it was placed vertically, the combustion state was observed when a flame contact for 12 seconds was performed with a hand burner from below, and the time from which the burner was removed to which self-extinguishing occurred was measured. The measurement was performed 5 times, and the average value was obtained.

Further, the engaging force was measured according to JIS L 3416-2000. Further, as a hook-and-loop fastener as an object to be engaged at that time, in the case where the hook-and-loop fastener of each of Examples and Comparative Examples is a hook hook-and-loop fastener, B48000 (manufactured by Kuraray Fastening Co., Ltd.) was used as a loop hook-and-loop fastener as an object to be engaged, in the case of the loop hook-and-loop fastener, using A48600 (manufactured by Kuraray Fastening Co., Ltd.) as a hook hook-and-loop fastener as an object to be engaged, and in the case of the hook-and-loop coexisting type hook-and-loop fastener, using the same hook-and-loop coexisting type hook-and-loop fastener as the object to be engaged, the measurement was performed.

As for the method of measuring the pull-out force of the engaging element, a tensile tester manufactured by SHIMADZU Corporation was used, the hook-and-loop fastener was folded in the width direction (weft yarn direction) so that the hook-shaped engaging element could be easily grasped and set in a chuck of the tensile tester, one hook-shaped engaging element of the set hook-and-loop fastener was grasped with pliers, the hook-shaped engaging element was pulled out from the base fabric at a tensile speed of 100 mm/min, and at that time, the maximum strength when the hook engaging element was pulled out from the base fabric of the hook-and-loop fastener was measured for the pull-out force of the engaging element. In the case of the loop hook-and-loop fastener, the yarn for the loop-shaped engaging element of the loop to be measured which subducts toward the base fabric and then floats toward the front face of the base fabric is cut at the top part of the front face of the base fabric, and the pull-out force of the engaging element is the value measured by the above method in this state. Further, in the case of the hook-and-loop coexisting type hook-and-loop fastener, the value of the pull-out force of the hook-shaped engaging element is used as the pull-out force of the engaging element. Arbitrary ten of them were evenly selected, their pull-out forces were measured, and the average value thereof was adopted.

Example 1

The following yarns were prepared as a warp yarn, a weft yarn, and a monofilament yarn for a hook-shaped engaging element constituting the base fabric of the flame-retardant hook hook-and-loop fastener.

[Warp Yarn]

Multifilament yarn made of PPS

Total decitex and number of filaments: 60 of 250 decitex

Twist number: 419 T/m

Dry-heat shrinkage percentage at 200° C.: 7.7%

[Weft Yarn (Non-Twisted Paralleled Yarn of the Following Two Types of Multifilament Yarns)]

Multifilament yarn made of the core-sheath composite filament

Core component: polyethylene terephthalate

Sheath component: polyethylene terephthalate copolymerized with 25 mol % of isophthalic acid (softening point: 190° C.)

Core-sheath ratio (weight ratio): 70:30

Total decitex and the number of filaments: 24 of 99 decitex

Dry-heat shrinkage percentage at 200° C.: 17.1%

Multifilament yarn made of PPS

Total decitex and number of filaments: 10 of 167 decitex

Dry-heat shrinkage percentage at 200° C.: 9.0%

[Monofilament Yarn for Hook-Shaped Engaging Element]

Monofilament yarn made of PPS

Diameter (before heat shrinkage): 0.20 mm

Dry-heat shrinkage percentage at 200° C.: 2.8%

[Production of Hook Hook-and-Loop Fastener]

Using the warp yarn, weft yarn, and the monofilament yarns for the hook-shaped engaging element, a plain woven was used as a woven structure, and the monofilament yarn for the hook-shaped engaging element was threaded in parallel to the warp yarn at a ratio of one thread per four threads of the warp yarn so as to have the weave density (after heat shrinkage treatment) of 56 threads of warp yarn/cm and 16.5 threads of weft yarn/cm and so as to alternately run over and under three threads of the weft yarn and then alternately run over one thread of the warp yarn, thus a loop was formed on the base fabric so as to form a loop at the running-over position.

Note that when the loop for the hook-shaped engaging element was formed, the method described below was used; the same number of metal rods having a uniform longitudinal cross section as the number of the yarns for the hook-shaped engaging elements was placed upright on the positions where the yarn for the hook-shaped engaging element runs over the warp yarn, parallel to the warp yarn, such that the longitudinal direction of the cross section was the height direction of the loop for the hook-shaped engaging element, the yarn for the engaging element runs over the upper part of the metal rod, and the metal rod was pulled out from the loop after the loop was formed.

A tape for the hook hook-and-loop fastener woven under the above conditions was subjected to a heat treatment by running in a heat treatment furnace for 60 seconds at a temperature of 246° C. at which only the sheath component of the weft yarn was heat-melted and the warp yarn, the monofilament yarn for the hook-shaped engaging element, and the core component of the weft yarn were not heat-melted, so that the warp yarn, weft yarn, and monofilament yarn for the hook-shaped engaging element were heat shrunk. As a result, the tape was shrunk by 8% in the weft yarn direction, and the sheath component was melted to fuse adjacent yarns.

Further, while the heat-fusible component (sheath component) of the weft yarn was kept in a molten state, as shown in FIG. 1, the woven-fabric tape for the hook hook-and-loop fastener was allowed to run along a stainless steel fixed surface having a mirror-finished surface placed in the immediate vicinity of the outlet of the heat treatment furnace in a state with a tensile force of 200 g/cm applied after passing through the fixed surface, the rear face was pressed against the fixed surface for 5 seconds and slid on the surface at a speed of 10 mm/sec for 5 seconds, and then the running direction was bent at 90° along the surface. Further, the obtained woven-fabric was cooled and one leg part of the loop for the hook-shaped engaging element was cut to form the hook-shaped engaging element.

As a result, the waving in the up-and-down direction of the hook-and-loop fastener was not observed at all, and as a result, cutting of one leg of the hook-shaped engaging element could be performed without any problem. Moreover, the weaving step, the heat treatment step, the step of press-bonding to the fixing surface, and the step of cutting one leg of the hook-shaped engaging element were continuously performed without winding in the middle.

[Properties and the Like of Obtained Hook Hook-and-Loop Fastener]

As for the widths of the obtained woven-fabric for the hook hook-and-loop fastener, the area where the engaging element is present has a width of 20 mm, and at both end parts thereof, the selvage parts having a width of 2.5 mm where the engaging element is not present are present in parallel in the warp yarn direction with a uniform width without meandering. As a result of measuring the flame retardancy of this hook hook-and-loop fastener, it was found that it was 3.4 seconds, which was extremely excellent and was at a level sufficiently acceptable for aircraft applications.

In this hook hook-and-loop fastener, the density of the hook-shaped engaging element was 56/cm$^2$, and the height of the hook-shaped engaging element from the face of the base fabric was 1.8 mm. When the cut state of the hook-shaped engaging element of the hook-and-loop fastener was observed, it was found that any hook-shaped engaging element was cut at a position of 70% of the height from the base of one leg. In addition, when the thickness (Tb) of the warp yarn in the base fabric thickness direction at the position where the warp yarn subducts most toward the rear face side and the thickness (Ts) of the warp yarn in the base fabric thickness direction at the position where the warp yarn floats most toward the front face side, of the hook hook-and-loop fastener were measured, (Tb) was 0.125 mm and (Ts) was 0.107 mm, and therefore, (Tb)/(Ts) was 0.86.

As a result of measuring the pull-out force of the hook-shaped engaging element of this hook hook-and-loop fastener from the base fabric, it was 6.3 N, and it was found that the pull-out resistance was also extremely excellent. Further, the presence or absence of a waving in the up-and-down direction of the hook-and-loop fastener was observed by a method of allowing the hook-and-loop fastener to stand on a flat glass plate without applying a load, and as a result, no waving was observed at all.

Further, when the engaging force of the hook hook-and-loop fastener was measured, the initial engaging force was 12.4 N/cm$^2$ in shear strength and 1.39 N/cm in peel strength, and the engaging force after 1000 times of engagement and peeling was 11.2 N/cm$^2$ in shear strength and 1.26 N/cm in peel strength. Even after the engagement and peeling were repeated 1000 times, the hook-shaped engaging element pulled out from the front face of the hook hook-and-loop fastener or the hook-shaped engaging element in which the hook state was fully extended and the engaging ability was lost was not observed at all. It was found that the hook hook-and-loop fastener was extremely excellent in spite of the absence of the back coating layer.

Furthermore, since this hook hook-and-loop fastener was flexible, it was attached as a fastener for the cuff of clothes by sewing the selvage parts using a sewing machine, but this did not deteriorate the appearance of the clothes. At this time, the sewing thread could be sewn so as to be present in a straight line at the central part of the selvage part without meandering in the selvage part, and the appearance was also excellent.

Comparative Example 1

[Production of Hook Hook-and-Loop Fastener]

A hook hook-and-loop fastener was produced in the same manner as in Example 1, except that the fixed surface made of stainless steel placed in the immediate vicinity of the outlet of the heat treatment furnace in Example 1 was taken out, while the heat-fusible multifilament yarn after the heat treatment was kept in a molten state, the operation of pressing the rear face side of the hook-and-loop fastener against the fixed surface was not performed, and a method of taking up with a roller after taking out from the heat treatment furnace and cooling was used.

[Properties and the Like of Obtained Hook Hook-and-Loop Fastener]

In the obtained hook hook-and-loop fastener, the area where the engaging element was present had a width of 20 mm, and at both end parts thereof, the selvage parts having an average width of 2.5 mm where the engaging element was not present were present in parallel in the warp yarn direction. The density of the hook-shaped engaging element of the hook hook-and-loop fastener was 56/cm$^2$, the height of the hook-shaped engaging element from the face of the base fabric was 1.8 mm, and a flame retardancy was 3.6 seconds, which were as excellent as those of Example 1. Further, when the cut state of the hook-shaped engaging element was observed, it was found in many places that the hook-shaped engaging element like the following was continuously present, for example, it was cut at a position close to the base thereof, and cut at a position close to the top part, and further, among the hook-shaped engaging elements, the base of one leg was not cut so as to maintain a loop shape, both legs were cut and did not have a hook shape, or one leg was cut only partway. Then, when this hook-and-loop fastener was allowed to stand on a horizontal glass plate, a large waving in the up-and-down direction and a fine waving were observed, and a portion lifted from the glass plate was repeatedly observed.

The pull-out force of the hook-shaped engaging element of the hook hook-and-loop fastener was measured and found to be 4.2 N, which was considerably inferior to that of Example 1. Further, the engaging force of this hook hook-and-loop fastener was measured. The initial engaging force was 11.6 N/cm$^2$ in shear strength and 1.28 N/cm in peel strength, and the engaging force after 1000 times of engagement and peeling was 9.7 N/cm$^2$ in shear strength and 1.02 N/cm in peel strength. After the engagement and peeling were repeated 1000 times, the hook-shaped engaging elements pulled out from the front face of the hook hook-and-loop fastener were found in many places.

The (Tb)/(Ts) of the hook hook-and-loop fastener was 0.96. Further, when, this hook hook-and-loop fastener was attached to the cuff of clothes by sewing with a sewing thread using the selvage part in the same manner as in Example 1, it was difficult to sew the central part with the sewing thread due to the meandering of the selvage parts, and the sewn hook-and-loop fastener on the cuff was inferior to that of Example 1 in terms of appearance because the sewing thread meandered in places.

Example 2

[Production of Loop Hook-and-Loop Fastener]

In the method of producing the hook hook-and-loop fastener in Example 1, a loop hook-and-loop fastener was produced in the same manner as in Example 1, except that the yarn for the engaging element was changed to the following multifilament yarn for the loop-shaped engaging element, plain woven was used as the woven structure, weaving was performed so as to have the weave density (after heat shrinkage treatment) of 54 threads of warp yarn/cm and 18.8 threads of weft yarn/cm, and the multifilament yarn for the loop-shaped engaging element was threaded in parallel into the warp yarn at a ratio of one thread per four threads of the warp yarn to alternately run over and under three threads of the weft yarn and then alternately run over one thread of the warp yarn, thereby forming a loop on the base fabric so as to form a loop at the running-over position. Since the engaging element was a loop-shaped engaging element, the cutting of one leg of the loop in the step D performed in Example 1 was not performed. Further, the weaving step, the heat treatment step, and the step of press-bonding to the fixing surface were continuously performed without winding.

[Yarn for Loop-Shaped Engaging Element]

Multifilament yarn made of PPS

Total decitex and number of filaments: 20 of 334 decitex

Dry-heat shrinkage percentage at 200° C.: 9.1%

[Properties and the Like of Obtained Loop Hook-and-Loop Fastener]

As for the widths of the obtained woven-fabric for the loop hook-and-loop fastener, the area where the engaging element was present had a width of 20 mm, and at both end parts thereof, the selvage parts having a width of 2.5 mm where the loop-shaped engaging element was not present were present in parallel in the warp yarn direction with the uniform widths. As a result of measuring the flame retardancy of the loop hook-and-loop fastener, it was found that it was 3.0 seconds, which was extremely excellent, and was at a level sufficiently acceptable for aircraft applications as in Example 1, and it could be combined with the one in Example 1 and used.

The density of the loop-shaped engaging element of the loop hook-and-loop fastener was 63/cm$^2$ and the height of the loop-shaped engaging element from the face of the base fabric was 2.1 mm. Further, the (Tb)/(Ts) of the loop hook-and-loop fastener was 0.88.

Next, as a result of measuring the pull-out force of this loop-shaped engaging element, it was found to be 10.3 N, and the pull-out resistance was also extremely excellent. Further, the presence or absence of a waving in the up-and-down direction of the loop hook-and-loop fastener was observed by placing the hook-and-loop fastener on a flat glass plate, and as a result, no waving was observed at all.

Further, the engaging force of this loop hook-and-loop fastener was measured. The initial engaging force was 12.2 N/cm$^2$ in shear strength and 1.38 N/cm in peel strength, the engaging force after 1000 times of engagement and peeling was 11.1 N/cm$^2$ in shear strength and 1.24 N/cm in peel strength. Even after the engagement and peeling were repeated 1000 times, the loop-shaped engaging element pulled out from the front face of the loop hook-and-loop fastener was not observed at all. It was found that the loop hook-and-loop fastener had an extremely excellent engaging force in spite of the absence of the back coating layer.

Further, since this hook hook-and-loop fastener was extremely flexible, when it was attached to the cuff of clothes by sewing with a sewing thread using the selvage part, the sewing thread was present in a straight line at the central part of the selvage part without meandering in the selvage part, and the appearance was also excellent.

Comparative Example 2

[Production of Loop Hook-and-Loop Fastener]

A loop hook-and-loop fastener was produced in the same manner as in Example 2, except that the stainless steel fixed surface placed in the immediate vicinity of the outlet of the heat treatment furnace in Example 2 was taken out, while the heat-fusible multifilament yarn after the heat treatment was kept in a molten state, the operation of pressing the rear face side of the hook-and-loop fastener against the fixed surface was not performed, and it was taken up with a roller after cooling.

[Properties and the Like of Obtained Loop Hook-and-Loop Fastener]

In the obtained loop hook-and-loop fastener, the area where the engaging element was present had a width of 20 mm, and at both end parts thereof, the selvage parts having an average width of 2.5 mm where the engaging element was not present were present in parallel in the warp yarn direction. The density of the loop-shaped engaging element of the loop hook-and-loop fastener was 63/cm$^2$, the height of the loop-shaped engaging element from the face of the base fabric was 2.1 mm, and the flame retardancy was 3.1 seconds. Further, when this hook-and-loop fastener was allowed to stand on a horizontal glass plate, a large waving in the up-and-down direction and a fine waving were observed as in the hook hook-and-loop fastener of Comparative Example 1.

Further, as a result of measuring the pull-out force of the loop-shaped engaging element from the face of the base fabric, it was 8.7 N, which was inferior to that of Example 2. Further, the engaging force of the loop hook-and-loop fastener was measured. The initial engaging force was 11.4 N/cm$^2$ in shear strength and 1.26 N/cm in peel strength, and the engaging force after 1000 times of engagement and peeling was 9.6 N/cm$^2$ in shear strength and 1.01 N/cm in peel strength. The engaging forces were inferior to those of Example 2, and the engaging forces after the engagement and peeling were repeated 1000 times were different from those of Example 2, and it was found that there were some loop-shaped engaging elements that were pulled out from the front face of the loop loop-and-hook fastener.

The (Tb)/(Ts) of the loop hook-and-loop fastener was 0.97. As in the case of Example 2, this loop hook-and-loop fastener was attached to the cuff of clothes by sewing with a sewing thread using the selvage part. However, it was difficult to sew the central part of the selvage part with the sewing thread, and as a result, it appeared that the sewing thread was meandered slightly, and the appearance was also inferior to that of Example 2.

Example 3

[Production of Hook-and-Loop Coexisting Type Hook-and-Loop Fastener]

Using the warp yarn, weft yarn, monofilament yarn for the hook-shaped engaging element and multifilament yarn for the loop-shaped engaging element used in Examples 1 and 2, were used to produce a hook-and-loop coexisting type hook-and-loop fastener.

Specifically, a plain woven was used as the woven structure at that time, the weave density (after the heat shrinkage treatment) was 54 threads of warp yarn/cm and 16.5 threads of weft yarn/cm, and the multifilament yarn for the loop-shaped engaging element or the monofilament yarn for the hook-shaped engaging element alternately runs over and under three threads of the weft yarn and then alternately runs over one thread of the warp yarn at a ratio of one thread per four threads of the warp yarn, thus a loop was formed on the base fabric so as to form a loop at the running-over position. At this time, the multifilament yarn for the loop-shaped engaging element and the monofilament yarn for the hook-shaped engaging element were woven so as to be each continuously and alternately present in a unit of two threads.

Other than that, weaving was performed in the same manner as in Example 1, and the hook-and-loop coexisting type hook-and-loop fastener was produced by heat-treating and pressing it against the fixed surface, and further, cutting one leg of loop for the hook-shaped engaging element, in the same manner as in Example 1. Further, the weaving step, the heat treatment step, the step of press-bonding to the fixing surface, and the step of cutting one leg of the hook-shaped engaging element were continuously performed without winding in the middle.

[Properties and the Like of Obtained Hook-and-Loop Coexisting Type Hook-and-Loop Fastener]

As for the widths of the obtained woven-fabric for the hook-and-loop coexisting type hook-and-loop fastener, the area where the engaging element was present had a width of 20 mm, and at both ends thereof, the selvage parts having a width of 2.5 mm where the engaging element was not present were present in parallel in the warp direction in a uniform width. The density of the hook-shaped engaging element was 28/cm$^2$, the density of the loop-shaped engaging element was 28/cm$^2$, the height of the hook-shaped engaging element from the face of the base fabric was 1.8 mm, and the height of the loop-shaped engaging element from the face of the base fabric was 2.1 mm. The hook-and-loop coexisting type hook-and-loop fastener had a flame retardancy of 3.2 seconds, which was at a level at which it could be used in aircraft applications as in Examples 1 and 2.

When the cut state of the hook-shaped engaging element of the hook-and-loop coexisting type hook-and-loop fastener was observed, it was found that all the hook-shaped engaging element were cut at a position corresponding to 70% of the height from the base of one leg. The (Tb)/(Ts) of the hook-and-loop coexisting type hook-and-loop fastener was 0.87.

Next, as a result of measuring the pull-out forces of the hook-shaped engaging element and the loop-shaped engaging element, they were 6.5 N and 9.9 N, respectively, and it was found that the pull-out resistance was also extremely excellent. Further, the presence or absence of a waving in the up-and-down direction of the hook-and-loop fastener was observed by placing the hook-and-loop fastener on a flat glass plate in the same manner as in Examples 1 and 2, and as a result, no waving was observed.

Further, the engaging force of the hook-and-loop coexisting type hook-and-loop fastener was measured. The initial engaging force was 10.1 N/cm$^2$ in shear strength and 1.02N/cm in peel strength, and the engaging force after 1000 times of engagement and peeling was 9.6 N/cm$^2$ in shear strength and 0.97 N/cm in peel strength, which were extremely excellent values for a hook-and-loop coexisting type hook-and-loop fastener. Moreover, even after the engagement and peeling were repeated 1000 times, the engaging element pulled out from the front face of the hook-and-loop coexisting type hook-and-loop fastener was not observed at all. It was found that the hook-and-loop coexisting type hook-and-loop fastener was extremely excellent in spite of the absence of the back coating layer.

Since the hook-and-loop coexisting type hook-and-loop fastener was extremely flexible, when the selvage part was used and sewn to the cuff of clothes with a sewing thread, the sewing thread could be sewn in a straight line at the central part of the selvage part without meandering in the selvage part, and the appearance was excellent.

Comparative Example 3

[Production of Hook-and-Loop Coexisting Type Hook-and-Loop Fastener]

A hook-and-loop coexisting type hook-and-loop fastener was produced in the same manner as in Example 3, except that the fixed surface attached immediately vicinity of the outlet of the heat treatment furnace in Example 3 was taken out, while the heat-fusible multifilament yarn after the heat treatment was kept in a molten state, the step of pressing the rear face side of the loop-and-hook fastener against the fixed surface was omitted, and the hook-and-loop fastener taken out from the heat treatment furnace after cooling was taken up with a roller.

[Properties and the Like of Obtained Hook-and-Loop Coexisting Type Hook-and-Loop Fastener]

In the obtained hook-and-loop coexisting type hook-and-loop fastener, the area where the engaging element was present had a width of 20 mm, and at both end parts thereof, the selvage parts having an average width of 2.5 mm where the engaging element was not present were present in parallel in the warp yarn direction. In the hook-and-loop coexisting type hook-and-loop fastener, the density of the hook-shaped engaging element was 28/cm$^2$, the density of the loop-shaped engaging element was 28/cm$^2$, the height of the hook-shaped engaging element from the face of the base fabric was 1.8 mm, and the height of the loop-shaped engaging element from the face of the base fabric was 2.1 mm. Further, the hook-and-loop coexisting type hook-and-loop fastener had an excellent flame retardancy of 3.4 seconds.

The cut state of the hook-shaped engaging element of the hook-and-loop coexisting type hook-and-loop fastener was observed. As similar to the case of Comparative Example 1, it was found that a small number of the hook-shaped engaging elements were cut at a position close to the base or cut at a position nearly close to the top part. Next, when this hook-and-loop fastener was allowed to stand on a horizontal glass plate and the state of the waving was observed, as in the case of the hook hook-and-loop fastener of Comparative Example 1 and the loop hook-and-loop fastener of Comparative Example 2, a large waving in the up-and-down direction and a fine waving therein were frequently observed.

Further, as a result of measuring the pull-out force of the hook-shaped engaging element and the pull-out force of the loop-shaped engaging element, they were 4.1 N and 8.6 N, respectively, which were both inferior to those of Example 3. Further, the engaging force of this hook-and-loop coexisting type hook-and-loop fastener was measured. The initial engaging force was 9.2 N/cm$^2$ in shear strength and 0.92 N/cm in peel strength, the engaging force after 1000 times of engagement and peeling was 8.1 N/cm$^2$ in shear strength and 0.80 N/cm in peel strength, and after the engagement and peeling were repeated 1000 times, it was found a small number of the hook-shaped engaging elements pulled out from the front face of the hook-and-loop coexisting type hook-and-loop fastener.

The (Tb)/(Ts) of the hook-and-loop coexisting type hook-and-loop fastener was 0.97. In the same manner as the hook-and-loop fastener of Example 3, this hook-and-loop coexisting type hook-and-loop fastener was sewn to the cuff of clothes with a sewing thread using the selvage part. However, it was difficult to sew the central part of the selvage part with the sewing thread, and as a result, it appeared that the sewing thread was meandered, and the appearance was also inferior to that of Example 3.

Example 4

[Production of Hook Hook-and-Loop Fastener]

A hook hook-and-loop fastener was produced in the same manner as in Example 1, except that the fixed surface pressed against when the heat-fusible core-sheath type filament was kept in a molten state in Example 1 was replaced with a mirror-finished roll surface made of stainless steel having a satin-finished surface. Note that the roll surface rolled at a speed slower than the running speed of the woven-fabric for the hook hook-and-loop fastener running in contact therewith by 5 mm/second, the contact time between the rear face of the base fabric and the roll surface was 5 seconds, and the woven-fabric was pressed against the roll surface while the heat-fusible fiber was kept in a molten state, and was slid on the roll surface. Further, the tensile force of 250 g/cm was applied to the base fabric after passing through the roll surface. Note that the weaving step to the heat treatment step, the step of press-bonding to the roll surface, and further, the step of cutting one leg of the hook-shaped engaging element were continuously performed without winding in the middle.

[Properties and the Like of Obtained Hook Hook-and-Loop Fastener]

As for the widths of the obtained woven-fabric for the hook hook-and-loop fastener, the area where the engaging element was present had a width of 20 mm, and at both ends thereof, selvage parts where the engaging element was not present had a width of 2.5 mm were present in parallel in the warp yarn direction with a uniform width. The density of the hook-shaped engaging element and the height of the hook-shaped engaging element from the face of the base fabric, of the hook hook-and-loop fastener were the same as those in Example 1. Further, the hook hook-and-loop fastener had a flame retardancy of 3.5 seconds, which was very excellent as in Example 1. The (Tb)/(Ts) of the hook hook-and-loop fastener was 0.92.

In addition, the pull-out force of the hook-shaped engaging element of the hook hook-and-loop fastener was 6.0 N, and it was found that the pull-out resistance was also excellent. Further, regarding the presence or absence of a waving in the up-and-down direction of the hook-and-loop fastener, as a result of placing the hook-and-loop fastener on a flat glass plate, a large waving was hardly observed, but portions slightly lifted from the glass surface were observed in some places. As for the cut state of the hook-shaped engaging element, each hook-shaped engaging element was cut at a position corresponding to about 70% of the height of one leg, but the cut position was slightly misaligned in the up-and-down direction.

Further, the engaging force of this hook hook-and-loop fastener was measured. The initial engaging force was 12.0 N/cm$^2$ in shear strength and 1.35 N/cm in peel strength, and the engaging force after 1000 times of engagement and peeling was 10.9 N/cm$^2$ in shear strength and 1.21 N/cm in peel strength, which were excellent values. Further, even after engagement and peeling were repeated 1000 times, the hook-shaped engaging element pulled out from the front face of the hook hook-and-loop fastener was hardly observed. When the selvage part of this hook hook-and-loop fastener was used and sewn to the cuff of clothes with a sewing thread, the sewing thread could be sewn in a substantially straight line at the central part of the selvage part without meandering, but some were slightly misaligned from the central part.

Example 5

[Production of Loop Hook-and-Loop Fastener]

As in Example 4, a loop hook-and-loop fastener was produced in the same manner as in Example 2, except that the fixed surface pressed against in a state in which the heat-fusible core-sheath type filament was kept in a molten state in Example 2 was replaced with a roll surface made of stainless steel having a satin-finished surface. In this case, the rolling speed and tension of the roll surface were the same as in Example 2.

[Properties and the Like of Obtained Loop Hook-and-Loop Fastener]

The widths of the obtained woven-fabric for the loop hook-and-loop fastener and the selvage part were the same as those in Example 2, and the selvage part was present in parallel in the warp yarn direction in a uniform width. Further, the density of the loop-shaped engaging element and the height of the loop-shaped engaging element from the face of the base fabric, of the hook-and-loop fastener were the same as those in Example 2. The loop hook-and-loop fastener had a flame retardancy of 3.3 seconds, which was extremely excellent. The (Tb)/(Ts) of the loop hook-and-loop fastener was 0.93.

In addition, the pull-out force of the loop-shaped engaging element of this loop hook-and-loop fastener was 9.6 N, and it was found that the pull-out resistance was also excellent. Further, regarding the presence or absence of a waving in the up-and-down direction of the hook-and-loop fastener, as a result of placing the hook-and-loop fastener on a flat glass plate, a large waving was hardly observed, but as in the case of the hook-and-loop fastener in Example 4, portions slightly lifted from the glass surface were observed in some places.

Further, the engaging force of the loop hook-and-loop fastener was measured. The initial engaging force was 11.8 N/cm$^2$ in shear strength and 1.31 N/cm in peel strength, and the engaging force after 1000 times of engagement and peeling was 10.5 N/cm$^2$ in shear strength and 1.17 N/cm in peel strength, which were somewhat excellent values. When the selvage part of the loop hook-and-loop fastener was used and sewn to the cuff of clothes with a sewing thread, the sewing thread could be sewn in a straight line at the central part of the selvage part without substantially meandering, but as in the case of Example 4, it was found that some of the selvage parts were misaligned from the central part, and the appearance was slightly inferior to that of Example 2.

Comparative Example 4

[Production of Hook Hook-and-Loop Fastener]

A hook hook-and-loop fastener was produced in the same manner as in Example 1 except that, as the weft yarn, a yarn made only of a multifilament yarn made of the following core-sheath type composite filament was used instead of using the paralleled yarn of the polyphenylene sulfide-based multifilament yarn and the multifilament yarn made of the heat-fusible filament in Example 1.

[Weft Yarn (Multifilament Yarn Made of Core-Sheath Type Composite Filament)]

The core component, the sheath component, and the core-sheath ratio were the same as those used in the weft yarn of Example 1

Total decitex and number of filaments: 48 of 240 decitex

Dry-heat shrinkage percentage at 200° C.: 17.0%

[Properties and the Like of Obtained Hook Hook-and-Loop Fastener]

There was no problem in the waving in the up-and-down direction of the obtained hook hook-and-loop fastener, the pull-out resistance of the engaging elements, the engaging force, and the like, but the flame retardancy was 19.2 seconds, which was far inferior to that of Example 1, and was not at a flame retardancy level usable for aircraft applications.

Example 6

[Production of Hook Hook-and-Loop Fastener]

In the same manner as in Example 1 except that the PPS-based multifilament yarn used for the paralleled yarn of the PPS-based multifilament yarn and the multifilament yarn made of the heat-fusible filament used as the weft yarn in Example 1 was changed to the following PPS-based multifilament yarn, there was produced a wide hook hook-and-loop fastener in which four areas each having a width of 20 mm where the engaging elements were present were in parallel in the warp yarn direction, three areas for the intermediate selvages each having a width of 5 mm and interposed between the selvage part having a width of 2.5 mm at one end part and the engaging element area were in parallel in the warp yarn direction, and the engaging element area and the area for the intermediate salvage were alternately present in the weft yarn direction, and finally, the central part of the area for the selvage was slit in parallel in the warp direction to produce four hook hook-and-loop fasteners. Note that the other production conditions were the same as in Example 1.

[Multifilament Yarn Made of PPS and Used as Paralleled Yarn of Weft Yarn]

Total decitex and number of filaments: 60 of 250 decitex

Dry-heat shrinkage percentage at 200° C.: 7.8%

[Properties and the Like of Obtained Hook Hook-and-Loop Fastener]

The density of hook-shaped engaging element for four hook hook-and-loop fasteners obtained and the height of the hook-shaped engaging elements from the face of the base fabric were substantially the same as those of Example 1. As for the cut state of the hook-shaped engaging elements of the hook-and-loop fastener, each hook-shaped engaging element was cut at a position corresponding to about 70% of the height of one leg. Further, as a result of measuring the flame retardancy of the hook hook-and-loop fastener, it was 2.0 seconds, which was very excellent as in Example 1. Further, the (Tb)/(Ts) of the hook hook-and-loop fastener was 0.87.

The pull-out force of the hook-shaped engaging element of the hook hook-and-loop fastener was 6.1 N, and the pull-out resistance was slightly inferior to that of Example 1, but was extremely excellent. Further, the waving in the up-and-down direction of the hook-and-loop fastener was not observed at all as in Example 1, and the central part of the area for the intermediate selvage was accurately slit, and the produced selvage part had a uniform width of 2.5 mm. When this hook-and-loop fastener was cut to a length of 15 cm and repeatedly washed 50 times, no fraying from the end part of the slit selvage part was observed.

Further, the engaging force of the hook hook-and-loop fastener was measured. The initial engaging force was 12.2 N/cm$^2$ in shear strength and 1.36 N/cm in peel strength, and the engaging force after 1000 times of engagement and peeling was 11.1 N/cm$^2$ in shear strength and 1.24 N/cm in peel strength, which were extremely excellent values. Even after the engagement and peeling were repeated 1000 times, the hook-shaped engaging element pulled out from the front face of the hook hook-and-loop fastener or the hook-shaped engaging element with the hook state fully extended was hardly observed.

When the selvage part of the hook hook-and-loop fastener was used and sewn to the cuff of clothes with a sewing thread, the sewing thread could be easily sewn in a straight line at the central part of the selvage part.

Comparative Example 5

[Production of Hook Hook-and-Loop Fastener]

Four sheets of hook hook-and-loop fasteners were produced in the same manner as in Example 6, except that the fixed surface made of stainless steel placed in the immediate vicinity of the outlet of the heat treatment furnace in Example 6 was taken out, while the heat-fusible multifilament yarn after the heat treatment was kept in a molten state, the operation of pressing the rear face side of the hook-and-loop fastener was not performed, and a method of taking up with a roller after cooling was used.

[Properties and the Like of Obtained Hook Hook-and-Loop Fastener]

As for each of the obtained hook hook-and-loop fasteners, as in Example 6, the engaging element area of a width of 20 mm had a width of 20 mm, and at both end parts thereof, the selvage parts having an average width of 2.5 mm were present in parallel in the warp yarn direction. The cut state of the hook hook-shaped engaging element of the hook-and-loop fastener was observed. The cut state was the same as that of Comparative Example 1, and a state of the waving in the up-and-down direction of the hook-and-loop fastener was also the same as that of Comparative Example 1. A large waving and a fine waving were observed, and a portion lifted from the glass plate was repeatedly observed. In the slit selvage part, it was difficult to accurately slit the central part of the area for the intermediate selvage so as to have a width of 2.5 mm due to the waving, and wide portions and narrow portions were observed in many places. Further, when this hook-and-loop fastener was cut to a length of 15 cm and repeatedly washed 50 times, about two tenths of the hook-and-loop fastener was observed to have fraying of the warp yarn from the end part of the slit selvage part.

The pull-out force and engaging force of the hook-shaped engaging element of this hook hook-and-loop fastener were substantially the same values as those of Comparative Example 1, and the number of the hook-shaped engaging elements pulled out from the front face after the engagement and peeling were repeated 1000 times was also the same as that of Comparative Example 1. The (Tb)/(Ts) of the hook hook-and-loop fastener was 0.96 as in Comparative Example 1. Furthermore, when this hook hook-and-loop fastener was attached to the cuff of clothes by a sewing machine using the selvage part, it was difficult to sew the central part of the selvage part with a sewing thread due to the uneven width and meandering of the selvage part.

Example 7

[Production of Loop Hook-and-Loop Fastener]

In the same manner as in Example 2 except that the PPS-based multifilament yarn used for the paralleled yarn of the PPS-based multifilament yarn and the multifilament yarn made of the heat-fusible filament used as the weft yarn in Example 2 was replaced with the same PPS-based multifilament yarn as used in Example 6, a loop hook-and-loop fastener in which the engaging element area having a width of 20 mm and the area for the selvage part having a width of 5 mm were alternately present in parallel in the weft yarn direction was produced, and finally, the central part of the area for the selvage part was slit in parallel in the warp direction to produce four loop hook-and-loop fastener, as in Example 6. Note that the other production conditions were the same as in Example 2 except that the tensile force after passing through the fixed surface was changed from 200 g/cm to 400 g/cm.

[Properties and the Like of Obtained Loop Hook-and-Loop Fastener]

The densities and heights from the face of the base fabric of the loop-shaped engaging elements for four hook-and-loop fasteners obtained were substantially the same as those in Example 2. As a result of measuring the flame retardancy of the loop hook-and-loop fastener, it was 3.3 seconds, which was extremely excellent as in Example 2. Further, the (Tb)/(Ts) of the loop hook-and-loop fastener was 0.82.

The pull-out force of the loop-shaped engaging element of the loop hook-and-loop fastener was 9.8 N, and the pull-out resistance was also extremely excellent. Further, the waving in the up-and-down direction of the hook-and-loop fastener was not observed at all as in Example 2, and the selvage part formed from the area for the intermediate selvage by slitting had a width of 2.5 mm and was present in a straight line parallel in the warp yarn direction. Further, when this hook-and-loop fastener was cut to a length of 15 cm and repeatedly washed 50 times, no fraying of the warp yarn from the slit selvage part was observed as in the case of the hook-and-loop fastener of Example 6.

Further, the engaging force of this loop hook-and-loop fastener was measured. The initial engaging force was 12.0 N/cm$^2$ in shear strength and 1.34 N/cm in peel strength, and the engaging force after 1000 times of engagement and peeling was 10.8 N/cm$^2$ in shear strength and 1.21 N/cm in peel strength, which were extremely excellent values. Even after the engagement and peeling were repeated 1000 times, the loop-shaped engaging element pulled out from the front face of the loop hook-and-loop fastener was not found at all. When the selvage part of the loop hook-and-loop fastener was used and sewn to the cuff of clothes with a sewing thread, the sewing thread could be sewn in a straight line at the central part of the selvage part, and the appearance was also excellent.

Comparative Example 6

[Production of Loop Hook-and-Loop Fastener]

Four sheets of loop hook-and-loop fasteners were produced in the same manner as in Example 7, except that the fixed surface made of stainless steel placed in the immediate vicinity of the outlet of the heat treatment furnace in Example 7 was taken out, while the heat-fusible multifilament yarn after the heat treatment was kept in a molten state, the operation of pressing the rear face side of the hook-and-loop fastener was not performed, and a method of taking up with a roller after cooling was used.

[Properties and the Like of Obtained Loop Hook-and-Loop Fastener]

As for each of the obtained loop hook-and-loop fasteners, as in Example 7, the engaging element area of a width of 20 mm had a width of 20 mm, and at both end part thereof, the selvage parts having an average width of 2.5 mm were present in parallel in the warp yarn direction. The waving in the up-and-down direction of the loop hook-and-loop fastener was also the same as that of Comparative Example 2, and a large waving and a fine waving were observed. In the slit selvage part, it was difficult to accurately slit the central part of the area for the intermediate selvage due to the waving, and wide portions and narrow portion were frequently observed.

The pull-out force and the engaging force of the loop-shaped engaging element of the loop hook-and-loop fastener were substantially the same values as those of Comparative Example 2. The (Tb)/(Ts) of the hook hook-and-loop fastener was 0.97 as in Comparative Example 2. Furthermore, when this loop hook-and-loop fastener was attached to the cuff of clothes using the selvage parts by a sewing machine, it was difficult to sew the central part with a sewing thread due to the non-uniformity and meandering of the selvage part.

Example 8

[Production of Hook Hook-and-Loop Fastener]

A hook hook-and-loop fastener was produced under the same conditions as in Example 1, except that, in Example 1, the tensile force after passing through the fixed surface was changed from 200 g/cm to 640 g/cm.

[Properties and the Like of Obtained Hook Hook-and-Loop Fastener]

The density of the hook-shaped engaging element and the height of the hook-shaped engaging element from the face of the base fabric of the hook-shaped engaging element, of the hook hook-and-loop fastener obtained were exactly the same as those of Example 1, and the cut states of the hook-shaped engaging element of the hook-and-loop fastener were also the same as those of Example 1 and extremely unified. Further, the flame retardancy was the same as that of Example 1 and was extremely excellent.

The thickness (Tb) of the warp yarn in the base fabric thickness direction of at the position where the warp yarn subducts most toward the rear face side and the thickness (Ts) of the warp yarn in the base fabric thickness direction at the position where the warp yarn floats most toward the front face side in the hook hook-and-loop fastener were measured. As a result, the (Tb)/(Ts) was 0.76.

The pull-out force of the hook-shaped engaging element of the hook hook-and-loop fastener was 6.2 N, and the pull-out resistance was also extremely excellent as in Example 1. Further, the waving in the up-and-down direction of the hook-and-loop fastener was not observed at all as in Example 1. Further, the engaging force of this hook hook-and-loop fastener was measured. The initial engaging force was 12.2 N/cm$^2$ in shear strength and 1.36 N/cm in peel strength, and the engaging force after 1000 times of engagement and peeling was 11.1 N/cm$^2$ in shear strength and 1.24 N/cm in peel strength, which were extremely excellent values. Even after the engagement and peeling were repeated 1000 times, the hook-shaped engaging element pulled out from the front face of the hook hook-and-loop fastener or a hook-shaped engaging element with the hook state fully extended was not observed at all.

When the selvage part of the hook hook-and-loop fastener was used and sewn to the cuff of clothes with a sewing thread, the sewing thread could be sewn in a straight line at the central part of the selvage part. However, since the base fabric of this hook-and-loop fastener was more rigid than that of Example 1, it was somewhat inferior in workability at the time of attaching to a cloth, and furthermore, it could not be said that it was necessarily suitable for use in clothes or the like with which bring a human body in contact due to the rigidity.

Example 9

[Production of Loop Hook-and-Loop Fastener]

A loop hook-and-loop fastener was produced under the same conditions as in Example 2, except that, in Example 2, the tensile force after passing through the fixed surface was changed from 200 g/cm to 560 g/cm.

[Properties and the Like of Obtained Loop Hook-and-Loop Fastener]

The density of the loop-shaped engaging element of the loop hook-and-loop fastener and the height of the loop-shaped engaging element from the face of the base fabric, of the obtained loop hook-and-loop fastener were exactly the same as those in Example 2. Further, the flame retardancy was the same as that of Example 2 and was extremely excellent. The (Tb)/(Ts) of the loop hook-and-loop fastener was 0.74.

The pull-out force of the loop-shaped engaging element of the loop hook-and-loop fastener was 10.2 N, and the pull-out resistance was also extremely excellent as in Example 2. Further, the waving in the up-and-down direction of the hook-and-loop fastener was not observed at all as in Example 2. When the engaging force of the loop hook-and-loop fastener was measured, the initial engaging force was 12.0 N/cm$^2$ in shear strength and 1.34 N/cm in peel strength, and the engaging force after 1000 times of engagement and peeling was 10.7 N/cm$^2$ in shear strength and 1.20 N/cm in peel strength, which were extremely excellent values. Even after the engagement and peeling were repeated 1000 times, the loop-shaped engaging element pulled out from the front face of the loop hook-and-loop fastener was not observed at all.

When the selvage part of the loop hook-and-loop fastener was used and sewn to the cuff of clothes with a sewing thread, the sewing thread was present in a straight line at the central part of the selvage part. However, since the base fabric of this hook-and-loop fastener was slightly more rigid than that of Example 2, it could not be said that it was necessarily suitable for use in the applications with which bring a human body in contact, as in the hook-and-loop fastener of Example 8.

Comparative Example 7

[Production of Hook Hook-and-Loop Fastener]

In Example 1, the fixed surface made of stainless steel having a mirror-finished surface, which had been installed in the immediate vicinity of the outlet of the heat treatment furnace, was moved away from the outlet by 85 cm, and heating was performed from the rear surface of the fixed surface such that the front surface temperature of the fixed surface became 160° C. A hook hook-and-loop fastener was produced in the same manner as in Example 1, except that the above-mentioned heat-treated woven-fabric tape for the hook hook-and-loop fastener of Example 1 was pulled out from the outlet of the heat treatment furnace and allowed to run for 85 cm (it was confirmed that the tape was naturally cooled during running and the heat-fusible component used in the weft yarn was sufficiently solidified), the rear face of the tape cooled was pressed against the fixed surface having the front surface temperature of 160° C. for 5 seconds while sliding it on the surface, and further, the running direction was bent at 90° along the surface, and the operation of taking up in a state in which the tensile force of 200 g/cm was applied after the fixed surface was passed through was performed.

[Properties and the Like of Obtained Hook Hook-and-Loop Fastener]

The obtained hook hook-and-loop fastener was similar to that in Comparative Example 1 in terms of properties, that is, it had the flame retardancy as excellent as that of Example 1. However, when it was placed on a horizontal glass plate, a large waving in the up-and-down direction and a fine waving were observed, and further, the hook-shaped engaging elements in which the base of one leg was not cut and remained in a loop shape, both legs were cut, and one leg was cut only partway were found in some places. The density of the hook-shaped engaging element was 56/cm$^2$, and the height of the hook-shaped engaging element from the face of the base fabric was 1.8 mm. Regarding the cut state of one leg of the hook-shaped engaging element, the leg cut at a position close to the base of the hook-shaped engaging element, the leg cut at a position close to the top part, and the like were slightly continuously found.

Further, the pull-out force of hook-shaped engaging element was 4.4 N, which was considerably inferior to that of Example 1. Further, the engaging force of this hook hook-and-loop fastener was measured. The initial engaging force was 11.8 N/cm$^2$ in shear strength and 1.29 N/cm in peel strength, and the engaging force after 1000 times of engagement and peeling was 9.9 N/cm$^2$ in shear strength and 1.04 N/cm in peel strength, and after the engagement and peeling were repeated 1000 times, hook-shaped engaging elements pulled out from the front face of the hook hook-and-loop fastener were found in many places.

The (Tb)/(Ts) of the hook hook-and-loop fastener was 0.96. When this hook hook-and-loop fastener was attached to a fabric with a sewing thread using the selvage part, it was difficult to sew the central part of the selvage part with the sewing thread, and as a result, it appeared that the sewing thread was meandered, and the appearance was also inferior to that of Example 1.

Comparative Example 8

[Production of Hook Hook-and-Loop Fastener]

The hook hook-and-loop fastener produced in Comparative Example 1 was wound, with the engaging-element face facing outward, in a roll shape on a stainless steel heating roll having a smooth front surface and a diameter of 12.5 cm such that it was not pressed, and in this state, a heat treatment was performed at 195° C. for 20 minutes. Note that in order to prevent the engaging element from falling down as much as possible due to the pressure when the hook-and-loop fastener was wound, a winding method was used in which the hook-and-loop fastener of the lower layer was wound so as not to be pressed by the hook-and-loop fastener of the upper layer, that is, so as not to be tightened as much as possible. Further, after the completion of the heat treatment, the hook-and-loop fastener was cooled and taken out from the heating roll, and the properties of the heat-treated hook hook-and-loop fastener, the state of the hook-shaped engaging element, and the like were observed and measured.

[Properties and the Like of Obtained Hook Hook-and-Loop Fastener]

As a result, at first glance, there was almost no difference from that of Comparative Example 1. When this hook-and-loop fastener was allowed to stand on a horizontal glass plate, a large waving in the up-and-down direction and a fine waving were observed, and it did not adhere to the glass plate, and the effect of solving the waving by the heat treatment was not obtained at all.

As a result of measuring the pull-out force of the hook-shaped engaging element of the hook hook-and-loop fastener, it was 4.1 N, which was substantially the same as that of Comparative Example 1. Further, the engaging force of the hook hook-and-loop fastener was measured. The initial engaging force and the engaging force after 1000 times of engagement and peeling were substantially the same as those of Comparative Example 1, and after the engagement and peeling were repeated 1000 times, the hook-shaped engaging elements pulled out from the front face of the hook hook-and-loop fastener were observed in many places.

The (Tb)/(Ts) of the hook hook-and-loop fastener was 0.96, which was the same as that of Comparative Example 1. Furthermore, when this hook hook-and-loop fastener was attached to the cuff of clothes by sewing with a sewing thread using the selvage part, it was difficult to sew the central part of the selvage part with the sewing thread, and the sewing thread meandered in places on the hook-and-loop fastener of the cuff that had been sewn.

Comparative Example 9

[Production of Hook Hook-and-Loop Fastener]

A hook hook-and-loop fastener was produced in the same manner as in Example 4, except that, in Example 4, the surface speed of the roll surface was the same as the running speed of the woven-fabric for the hook hook-and-loop fastener so that the rear face of the woven-fabric was pressed against the roll surface but did not slide on the roll surface.

[Properties and the Like of Obtained Hook Hook-and-Loop Fastener]

The cut state of the hook-shaped engaging element of the obtained hook hook-and-loop fastener was improved from the state of Comparative Example 1, but the hook-shaped engaging elements in which a position close to the base of was cut, a position close to the top part was cut, the base of one leg was not cut to keep a loop shape, both legs were cut such that a hook shape was not kept, one leg was cut only partway, and the like were found. Although the waving condition of the hook-and-loop fastener was improved as compared to Comparative Example 1, a large waving was partially observed and a fine waving was observed.

The pull-out force of the hook-shaped engaging element of the hook hook-and-loop fastener, the engaging force, the pull-out condition of the hook-shaped engaging element from the front face of the hook hook-and-loop fastener after the engagement and peeling were repeated 1000 times, and the like were the same as those of Comparative Example 1. Further, the (Tb)/(Ts) of the hook hook-and-loop fastener was 0.95.

Further, the attachment condition of the hook hook-and-loop fastener to the clothes by the sewing thread using the selvage part was slightly improved as compared to that of Comparative Example 1, but the result was substantially similar to that of Comparative Example 1.

Comparative Example 10

[Production of Loop Hook-and-Loop Fastener]

A loop hook-and-loop fastener was produced in the same manner as in Example 5, except that, in Example 5, the surface speed of the roll surface was same as the running speed of woven-fabric for the loop hook-and-loop fastener as in Comparative Example 9, so that the rear face of the woven-fabric for the loop hook-and-loop fastener was pressed against the roll surface but did not slide on the roll surface.

[Properties and the Like of Obtained Loop Hook-and-Loop Fastener]

The (Tb)/(Ts) of the obtained loop hook-and-loop fastener was 0.96, and the pull-out force of the loop-shaped engaging element was 8.8 N, which were similar to those of Comparative Example 2. Further, the waving of the hook-and-loop fastener in the up-and-down direction was hardly improved, and a large number of lifted portions were observed as in Comparative Example 2. Furthermore, as in the case of Comparative Example 9, pull-out force of the loop hook-and-loop fastener, the ease of sewing using the selvage part, and the like were inferior.

Example 10

The hook hook-and-loop fastener obtained in Example 1, the loop hook-and-loop fastener obtained in Example 2 and the hook-and-loop coexisting type hook-and-loop fastener obtained in Example 3 were each dyed under the following conditions to obtain three kinds of hook-and-loop fastener dyed in dark black.

[Dyeing Conditions]

Dye: Tuxedo Black H (manufactured by DyStar Singapore Pte Ltd.) 7% owf

Auxiliary Agent: NICCA SUNSOLT SN130 (manufactured by Nicca Chemical Co., Ltd.) 2 g/l TEXPORT SN10 (manufactured by Nicca Chemical Co., Ltd.) 2 g/l SUNMORL 120 1 g/l Acetate 2 g/l

MYS 0.10%

Bath ratio: 1:15

Dyeing temperature and time: 135° C.×120 minutes (temperature was raised from 40° C. to 135° C. in 30 minutes, and maintaining at 135° C. for 120 minutes)

Reduction washing: sodium hydroxide 1 g/l

Thiourea dioxide 0.5 g/l

ESKUDO NEO-2E 1 g/l

80° C.×15 minutes

Rinsing with water: 15 minutes

Drying: 60° C.×30 minutes

All of the hook-and-loop fastener were dyed in a deep color, and the dyed products were excellent in both fastness to rubbing and fastness to hot water, and were sufficiently durable for use under severe conditions. Further, the flame retardancy and the engaging force were not different from those before the dying, and the (Tb)/(Ts) was not different from those before the dying.

REFERENCE SIGNS LIST

1: base fabric (loop woven-fabric)
2: loop for engaging element
3: heat treatment furnace
4: fixed surface or roll surface
5: warp yarn
6: weft yarn
7: hook-shaped engaging element
K: base fabric thickness direction
Tb: thickness of warp yarn in base fabric thickness direction at position at which warp yarn subducts most toward rear face side
Ts: thickness of warp yarn in base fabric thickness direction at position at which warp yarn floats most toward front face side

The invention claimed is:

1. A flame-retardant hook-and-loop fastener comprising:

a base fabric woven from a warp yarn formed of a polyphenylene sulfide-based multifilament yarn, a weft yarn formed of a polyphenylene sulfide-based multifilament yarn and a multifilament yarn formed of a heat-fusible filament, and a yarn for an engaging element formed of at least one selected from the group consisting of a polyphenylene sulfide-based multifilament yarn and monofilament yarn, and the engaging element formed of the yarn for the engaging element and being present on a front face of the base fabric, wherein a thickness of the warp yarn in a base fabric thickness direction at a position at which the warp yarn, which alternately runs over and under the weft yarn with the weft yarn interposed therebetween, subducts most toward a rear face side is 0.94 times or less of a thickness of the warp yarn in the base fabric thickness direction at a position at which the warp yarn floats most toward a front face side.

2. The flame-retardant hook-and-loop fastener according to claim 1, wherein the warp yarn, which alternately runs over and under the weft yarn with the weft yarn interposed therebetween, satisfies a range that the thickness of the warp yarn in the base fabric thickness direction at the position at which the warp yarn subducts most toward the rear face side is 0.70 to 0.90 times the thickness of the warp yarn in the base fabric thickness direction at the position at which the warp yarn floats most toward the front face side.

3. The flame-retardant hook-and-loop fastener according to claim 1, wherein the weft yarn is a paralleled yarn of: a polyphenylene sulfide-based multifilament yarn having a total thickness of 120 to 300 decitex in which 5 to 90 filaments having a thickness of 3 to 30 decitex are bundled; and a heat-fusible multifilament yarn having a total thickness of 80 to 150 decitex in which 15 to 40 polyester-based core-sheath type filaments having a thickness of 3 to 8 decitex in which a sheath component is a heat-fusible component having a low melting point are bundled.

4. The flame-retardant hook-and-loop fastener according to claim 1, wherein, on the front face of the hook-and-loop fastener, each of an engaging element area on which the engaging element is present and an area for a selvage part on which the engaging element is not present is continuous in a warp yarn direction, and the engaging element area and the area for the selvage part are alternately present, and further, a plurality of engagement element areas are present, in a weft yarn direction.

5. The flame-retardant hook-and-loop fastener according to claim 1, wherein the engaging element is a hook-shaped engaging element, and a pull-out force of the hook-shaped engaging element from the base fabric is 5 N or more.

6. The flame-retardant hook-and-loop fastener according to claim 1, wherein a back coating resin layer is not present on the rear face of the base fabric.

7. The flame-retardant hook-and-loop fastener according to claim 1, which is colored with a pigment or a disperse dye.

8. A method for producing a flame-retardant hook-and-loop fastener, the flame-retardant hook-and-loop fastener comprising:

a base fabric woven from a warp yarn formed of a polyphenylene sulfide-based multifilament yarn, a weft yarn formed of a polyphenylene sulfide-based multifilament yarn and a multifilament yarn formed of a heat-fusible and heat-shrinkable filament, and a yarn for an engaging element formed of at least one selected from the group consisting of a polyphenylene sulfide-based multifilament yarn and monofilament yarn, and at least one selected from the group consisting of a large number of hook-shaped engaging elements and a large number of loop-shaped engaging elements, formed of the yarn for the engaging element and present on the front face of the base fabric, wherein step A, step B, step C, and step D as described below are performed in this order;

[step A] a step of, at a time of weaving the base fabric from the warp yarn and the weft yarn, weaving the yarn for the engaging element into the warp yar in parallel, and at the same time, allowing the yarn for the engaging element to regularly run over the warp yarn, and raising the yarn for the engaging element in a loop shape from the front face of the base fabric at a running-over position to weave a loop woven-fabric;

[step B] a step of guiding the loop woven-fabric to a heating region, heating at a temperature equal to or higher than a temperature at which a heat-fusible component of the multifilament yarn made of the heat-fusible and heat-shrinkable filament is melted, heat-shrinking the multifilament yarn made of the heat-fusible and heat-shrinkable filament, and fixing the yarn for the engaging element to the base fabric by a melt from the multifilament yarn made of the heat-fusible and heat-shrinkable filament;

[step C] a step of taking out the loop woven-fabric from the heating region of the step B and sliding a rear face of the base fabric on a fixed surface or a roll surface while pressing the rear face against the fixed surface or the roll surface in a state in which the heat-fusible component of the multifilament yarn made of the heat-fusible and heat-shrinkable filament is melted;

[step D] a step of taking out the loop woven-fabric from the step C, cooling the loop woven-fabric, and then cutting one leg of the loop to form a hook-shaped engaging element from the loop when the yarn for the engaging element is a monofilament yarn.

9. The method for producing the flame-retardant hook-and-loop fastener according to claim 8, wherein, in the step C, while the rear face of the loop woven-fabric is pressed against the fixed surface, the loop woven-fabric is allowed to run while sliding on the fixed surface, and a running direction of the loop woven-fabric is changed on the fixed surface.

10. The method for producing flame-retardant hook-and-loop fastener according to claim 8, wherein the step C is carried out by utilizing a residual heat of the step B following the step B without once cooling the loop woven-fabric taken out from the step B.

11. The method for producing the flame-retardant hook-and-loop fastener according to claim 8, wherein the multifilament yarn made of the heat-fusible and heat-shrinkable filament has a dry-heat shrinkage percentage at 200° C. in a range of 10 to 24%.

12. The method for producing the flame-retardant hook-and-loop fastener according to claim 8, wherein a tensile force applied to the loop woven-fabric in the step C is 50 to 600 g/cm.

13. The method for producing the flame-retardant hook-and-loop fastener according to claim 8, the method comprising continuously performing the step A to an end of the step D without winding in a middle.

14. The method for producing the flame-retardant hook-and-loop fastener according to claim 8, the method comprising: in the step A, weaving the loop woven-fabric in which an engaging element area on which a loop for the engaging element is present and an area for a selvage part on which the loop for the engaging element is not present are each continuously present in a warp direction on the front face of the loop woven-fabric, and the engaging element area and the area for the selvage part are alternately present, and further a plurality of areas for the engaging element is present, in a weft yarn direction; and after the step D, slitting a center of the area for the selvage part in the warp yarn direction to simultaneously produce a plurality of hook-and-loop fasteners that is continuous in the warp direction and that has selvage parts at both end parts.

* * * * *